US006203662B1

(12) United States Patent
Snekkenes et al.

(10) Patent No.: US 6,203,662 B1
(45) Date of Patent: Mar. 20, 2001

(54) METHOD FOR THE CONTINUOUS COOKING OF PULP IN A DIGESTER SYSTEM HAVING A TOP SEPARATOR

(75) Inventors: Vidar Snekkenes; Johan Engström; Krister Olsson, all of Karlstad; Mikael Lindström; Christofer Lindgren, both of Stockholm; Sören Gustavsson, Karlstad, all of (SE)

(73) Assignee: Kvaerner Pulping AB (SE)

( * ) Notice: Subject to any disclaimer, the term of this patent is extended or adjusted under 35 U.S.C. 154(b) by 0 days.

(21) Appl. No.: 09/024,464

(22) Filed: Feb. 17, 1998

Related U.S. Application Data

(63) Continuation-in-part of application No. 08/908,285, filed on Aug. 7, 1997, now Pat. No. 6,123,807.

(51) Int. Cl.[7] ..... D21C 7/12

(52) U.S. Cl. ..... 162/17; 162/37; 162/39; 162/41

(58) Field of Search ..... 162/17, 19, 34, 162/41, 49, 52, 37, 39

(56) References Cited

U.S. PATENT DOCUMENTS 5,089,086 2/1992 Silander ..... 162/19
5,779,856 * 7/1998 Kettunen ..... 162/34

FOREIGN PATENT DOCUMENTS 9001467-1 4/1990 (SE) .

* cited by examiner

*Primary Examiner*—Dean T. Nguyen
(74) *Attorney, Agent, or Firm*—Fasth Law Office; Rolf Fasth

(57) ABSTRACT

This invention relates to a new and improved way of continuously cooking fiber material, wherein temperatures and alkaline levels are controlled to be maintained within specific levels in different zones of the digesting process in order to optimize chemical consumption and heat-economy, and, at the same time, achieving very good pulp properties.

25 Claims, 14 Drawing Sheets

FIG. 10

LABORATORY COOKING

GENERAL CONDITIONS

| | |
|---|---|
| Wood specie: | Scandinavian softwood, chips |
| Steaming, minutes | 5 |
| Temperature, °C | 110 |
| Pressure, bar | 1.0 |
| Sulfidity, % | 36.4 |

SPECIFIC CONDITIONS

| | Reference | Present Invention |
|---|---|---|
| Cook no. | ITC 1770 | ITC 1763 |
| IMPREGNATION | | |
| Time, minutes | 45 | 45 |
| Temperature, °C | 125 | 125 |
| Alkali consumption, kg EA/BDMT wood | 99 | 92 |
| CONCURRENT COOKING | | |
| Time, minutes | 120 | 120 |
| Temperature, °C | 160 | 145 |
| Alkali consumption, kg EA/BDMT wood | 63 | 66 |
| COUNTERCURRENT COOKING | | |
| Time, minutes | 150 | 150 |
| Temperature, °C | 160 | 155 |
| Alkali consumption, kg EA/BDMT wood | 15 | 10 |
| RESULTS | | |
| H-Factor | 1850 | 874 |
| Alkali consumption, kg EA/BDMT wood | 177 | 168 |

Compact cooked pulp: $O^2$ Kappa 11.1 and visc. 1018 $dm^3/kg$
Reference cooked pulp: $O^2$ Kappa 11.2 and visc. 1014 $dm^3/kg$

METHOD FOR THE CONTINUOUS COOKING OF PULP IN A DIGESTER SYSTEM HAVING A TOP SEPARATOR

PRIOR APPLICATION

This is a continuation-in-part application of U.S. patent application Ser. No. 08/908,285, filed Aug. 7, 1997 now U.S. Pat. No. 6,123,807.

TECHNICAL FIELD

The present invention relates to a novel method for producing pulp, preferably sulphate cellulose, with the aid of a continuous cooking process.

BACKGROUND INFORMATION AND SUMMARY OF THE INVENTION

Environmental demands has forced our industry to develop improved cooking and bleaching methods. One recent breakthrough within the field of cooking is ITC™, which was developed in 1992–1993. ITC™ is described in WO-9411566, which shows that very good results concerning the pulp quality may be achieved. ITC™ is mainly based on using almost the same temperature (relatively low compared to prior art) in all cooking zones in combination with moderate alkaline levels. The ITC™-concept does not merely relate to the equalization of temperatures between different cooking zones, but a considerable contribution of the ITC™-concept relates to enabling an equalized alkaline profile also in the lower part of the counter-current cooking zone.

Moreover, it is known that impregnation with the aid of black liquor can improve the strength properties of the fibers in the pulp produced. The aim of the impregnation is, in the first place, to thoroughly soak each chip so that it becomes susceptible, by penetration and diffusion, to the active cooking chemicals which, in the context of sulphate cellulose, principally consist of sodium hydroxide and sodium sulphide.

If, as is customary according to prior art, a large proportion of the white liquor is supplied in connection with the impregnation, there will exist no distinct border between impregnation and cooking. This leads to difficulties in optimizing the conditions in the transfer zone between impregnation and cooking.

Now it has been found that surprisingly good results can be achieved when:

1. Keeping a low temperature but a high alkali content in the beginning of a concurrent cooking zone of the digester;
2. Withdrawing a substantial part of a highly alkaline spent liquor that has passed through at least the concurrent cooking zone; and
3. Supplying a substantial portion of the withdrawn spent liquor that has a relatively high amount of rest-alkali, to a point that is adjacent the beginning of an impregnation zone.

This leads to a reduced H-factor demand, reduced consumption of cooking chemicals and better heat-economy. Additionally, the novel method leads to the production of pulp that has a high quality and a very good bleachability, which means that bleach chemicals and methods can be chosen with a wider variety than before for reaching the desired quality targets (brightness, yield, tear-strength, viscosity, etc.) of the finally bleached pulp.

Furthermore, we have found that these good results can also be achieved when moving in a direction opposite the general understanding of the ITC™-teaching, in connection with digesters having a counter-current cooking zone. Instead of trying to maintain almost the same temperature levels in the different cooking zones, we have found that when using a digester that has both a concurrent and a counter-current cooking zone, big advantages may be gained if the following basic steps are used:

1. Keeping a low temperature but a high alkali content in the concurrent zone of the digester;
2. Keeping a higher temperature but a lower alkali content in the counter-current zone;
3. Withdrawing a substantial part of the highly alkaline spent liquor that has passed through at least one digesting zone; and
4. Preferably supplying almost all of the withdrawn spent liquor, that has a relatively high amount rest-alkali, to a position that is adjacent the beginning of the impregnation zone.

Additionally, it has been found very advantageous to take the spent liquor to be recovered from the spent liquor contained in the liquor that has been separated from the fibers in the separator.

Also, in connection with digesters of the one-vessel type (without a separate impregnation vessel), surprisingly good results are achieved when the same basic principles of the invention are used.

Moreover, preliminary results indicate that the preferred manner of using the invention may be somewhat modified also in other respects but still achieving very good result, e.g., by excluding the counter-current cooking zone. Additionally, expensive equipment might be eliminated, e.g., strainers in the impregnation vessel, hanging central pipes, etc., making installations much easier and considerably less expensive.

BRIEF DESCRIPTION OF THE FIGURES

FIG. 10 shows which conditions were used in the laboratory for one of the ITC-references and one of the cooks according to the invention (so called modified ITC);

DETAILED DESCRIPTION

Figure 1:
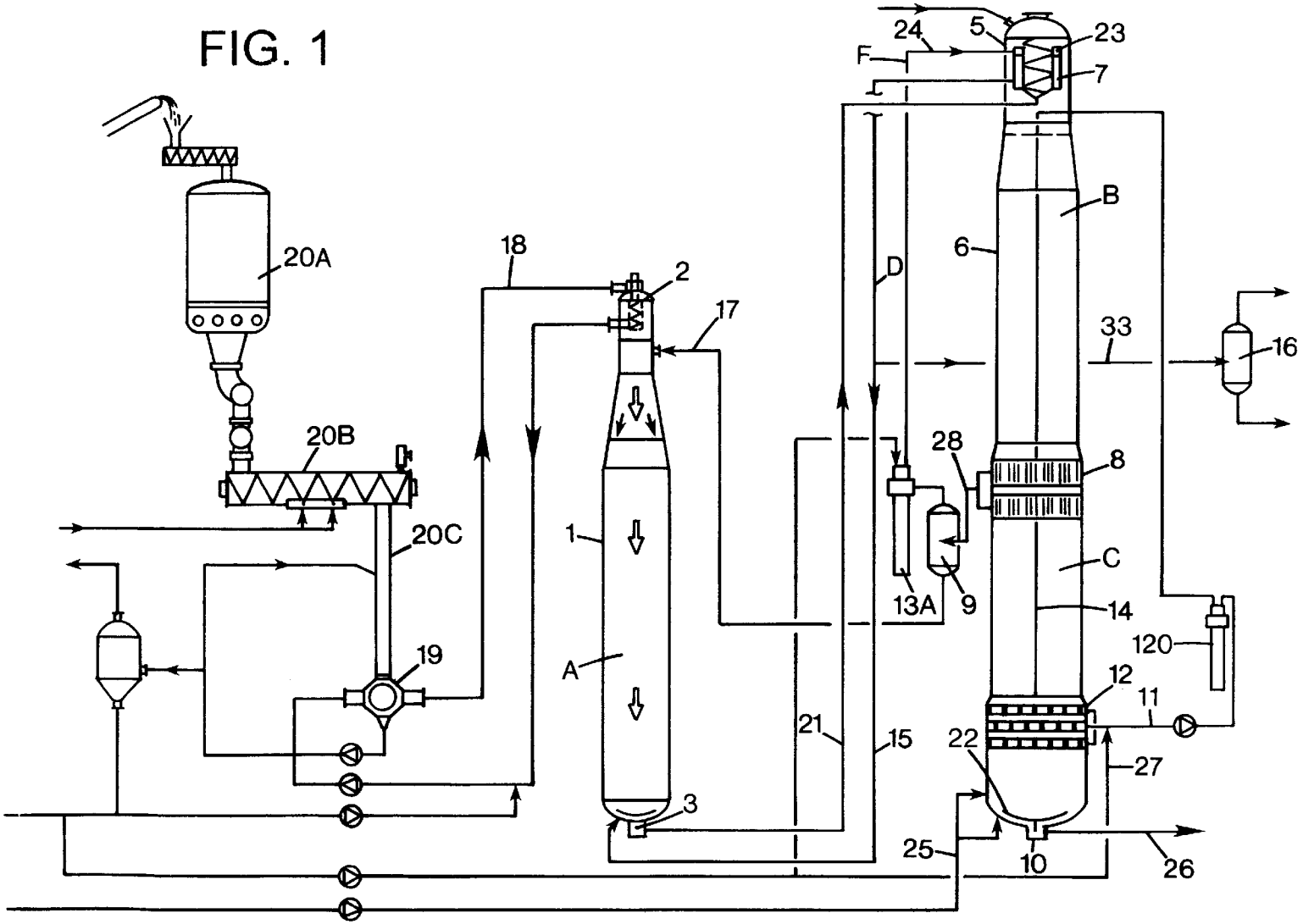
FIG. 1 is a schematic flow diagram of a preferred first embodiment of a digester system according to the present invention.

FIG. 1 shows a preferred embodiment of a two vessel steam/liquid-phase digester for producing chemical pulp according to the invention. The main components of the digesting system consist of an impregnation vessel 1 and a steam/liquid-phase digester 6.

The impregnation vessel 1, which normally is totally liquid filled has a feeding-in device 2 disposed at the top. This feeding-in device may be of a conventional type, i.e., a top separator with a screw-feed device that feeds the chips in a downward direction at the same time as transport liquid is drawn off. At the bottom, the impregnation vessel may have a feeding-out device 3 comprising a bottom scraper. In addition a conduit 17 for adding hot black liquor is attached to the impregnation vessel 1. As seen, the black liquor is preferably supplied at the top of the impregnation vessel. In contrast to conventional impregnation vessels, no draw-off screen is located on the impregnation vessel. However, such draw-off may be provided, if so desired.

The chips are fed from a chip bin 20A, through a steaming vessel 20B and a chip chute 20C. Finally, a feeding device, preferably a high-pressure feeder 19, feeds the chips via a conduit 18 to the top of the impregnation vessel 1. The feeder 19 is arranged to a chute, and is connected to necessary liquid circulations and replenishment.

A conduit 21 for transporting chips extends from the bottom of the impregnation vessel 1 up to the top 5 of the digester 6 having a steam space, wherein the liquid level being indicated by means of a broken line. A supply line for steam at the top provides for heating of the steam space. The conduit 21 opens out at the bottom of a top separator 7 which feeds by means of a screw in an upwardly moving direction. The screen of the separator is used to draw off the liquid D (which is then returned in the return line 15) together with which the chips are transported up to the top. An important feature of the present invention is that a substantial portion of all the spent liquor that is conveyed to a recovery unit 16 is taken from the free liquid (D) in the return line 15 via a conduit 33.

Figure 2:
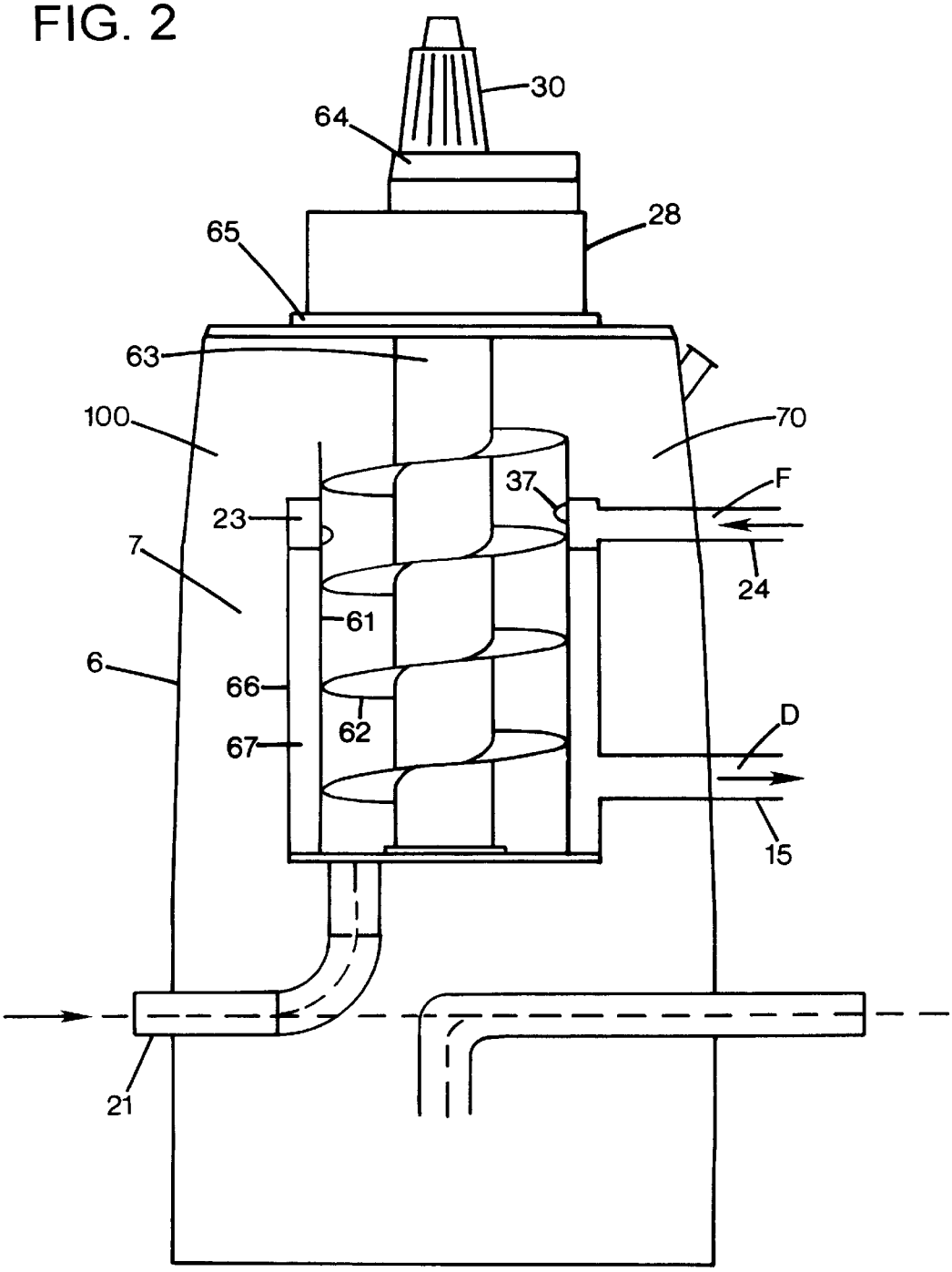
FIG. 2 is a cross-sectional view of a preferred top separator to be used in a steam/liquid-phase digester according to the present invention.

At the upper edge of the screen (over which edge the chips tumble out), there is arranged an integrated annular ring 23 (best seen in FIG. 2). The annular ring 23 is connected to a conduit 24 which (preferably via a heat-exchanger 13A) leads to a white-liquor container (not shown). A screen girdle section 8 is arranged in conjunction with a step-out approximately in the middle of the digester 6. Draw-off from this screen girdle section 8 can be conducted directly via conduit 17 to the impregnation vessel 1. Preferably, however, the black liquor is drawn off via a conduit 28 to a first flash cyclone 9. The first flash cyclone may be in operative engagement with the heat exchanger 13A to provide steam to the heat exchanger.

At the bottom 10 of the digester, there is a feeding-out device including one scraping element 22.

According to a preferred alternative, a "cold-blow" process is carried out so that the temperature of the pulp is cooled down at the bottom of the digester with the aid of relatively cold (preferably 70–80° C.) liquid (washing liquid) which is added by means of the scraping element 22 and/or other liquid-adding devices 25 (such as annular pipes) at the bottom of the digester, and then subsequently conducted upwards in counter-current. With the aim of being able to produce high-quality pulp having a low and equal kappa number, it is essential to distribute chemicals and heat evenly across the digester, so that all fibers in the column are treated under the same conditions.

This is achieved by means of a lower circulation 11, 12, 13, 14, a so-called ITC™ circulation. This lower circulation consists of a screen girdle section 12 (in the shown embodiment consisting of three rows) which is disposed at a sufficient height above the lower liquid-addition point 22 and/or 25 to permit the attainment of a desired flow from the latter liquid-addition point towards the screen section 12. The draw-off from the screen girdles 12, is recirculated (for displacing black liquor in counter-current to the draw-off screen 8) into the digester with the aid of a central pipe 14 (or alternately a stand pipe from the bottom of the digester) which opens out approximately on a level with the screen girdle section 12. A heat exchanger 120 for temperature regulation (increasing the temperature of the re-introduced liquid) and a pump are also located in the conduit 11 which connects the screen girdle 12 with the central pipe 14.

The recirculation loop 11 is also connected via a branch conduit 27 to the white liquor supply so that fresh alkali can be supplied and, in the form of counter-current cooking, further reducing the kappa number. The digester construction described is notable for the lack of a plurality of central pipes arranged from above and hanging downwards, as well as of feed pipes connected to them and of other necessary parts for the circulations.

A preferred operation according to the invention may function as follows. The chips are fed in into the chip bin 20A, subsequently steamed 20B and thereafter forwarded into the chute 20C. The high-pressure feeder 19 (which is supplied with a minor amount of white liquor, such as 5% of the total amount, in order to lubricate the feeder) with the aid of which the chips are fed into the conduit 18 together with the transport liquid. The slurry of the chips and the liquid that is fed to the top of the impregnation vessel in this way may have a temperature of about 110–120° C. on entry to the impregnation vessel (excluding recirculated transport liquor).

In addition to the actual fibers in the wood, the latter also conveys its own moisture (the wood moisture), which normally constitutes about 50% of the original weight, to the impregnation vessel. Over and above this, some condense is present from the steaming, i.e., at least a part of the steam (principally low-pressure steam) which was supplied to the steaming vessel 20B is cooled down to such a low level that it condenses and is then recovered as liquid together with the wood and the transport liquid.

At the top of the impregnation vessel 1, there is a screw feeder 2 that pushes chips from above and downwards into the impregnation vessel. No liquid is preferably recirculated within the impregnation vessel. Instead, liquid from a point that is after the first flash 9 is supplied. If desired, however, such recirculation may be provided in the impregnation vessel.

The chips which are fed out from the bottom of the top screen 2 then move slowly downwards in a plug flow through the impregnation vessel 1 in a liquid/wood ratio between 2/1–10/1 preferably between 3/1–8/1, more preferred of about 4/1–6/1. Hot black liquor, which is drawn off from the first flash 9, is added, via conduit 17, to the top of the impregnation vessel 1. The high temperature of the black liquor (100–160° C.), preferably exceeding 130° C., more preferred between 130–160° C., ensures rapid heating of the chips. In addition, the relatively high pH, exceeding pH 10, of the black liquor neutralizes acidic groups in the wood and also any acidic condensate accompanying the chips, thereby, i.e., counteracting the formation of encrustation, so-called scaling.

An additional advantage of the method of the present invention is that the black liquor supplied into the impregnation vessel has a high content of rest alkali, (EA as NaOH), at least 13 g/l, preferably about or above 16 g/l and more preferred between 13–30 g/l at the top of the impregnation vessel. This alkali mainly comes from the black liquor due to the high amount of alkali in the concurrent zone B of the digester. Furthermore, the strength properties of the fibers are positively affected by the impregnation because the high amount of sulphide. The major portion of black liquor is directly (or via one flash) fed to the impregnation vessel 1. A minor amount of the black liquor may be used for transferring the chips from the HP-feeder to the inlet of the impregnation vessel.

This minor flow should then be cooled (not shown) before it is entered into the feeder. The two flows of black liquor are preferably used to regulate the temperature within the impregnation zone A. Preferably the temperature is less than 140° C. However, the temperature of the black liquor may also be between about 140° C. and about 160° C. The total supply of black liquor to the impregnation vessel exceeds 80% of the amount drawn off from the draw-off strainers 8, preferably more than 90% and optimally about 100% of the total flow, which normally is about 8–12 $m^3$/ADT.

The chips, which have been thoroughly impregnated and partially delignified in the impregnation vessel, are fed to the top of the digester 6 and conveyed into the upwardly-feeding top separator 7. The chips are thus fed upwardly through the screen, meanwhile free transport liquid is withdrawn outwardly through the screen and finally the chips fall out over the edge of the screen down through the steam space. Before or during their free fall, the chips pieces are drained with cooking liquor which is supplied by means of the top separator 7. The white liquor is preferably heated by the heat exchanger 13A that preferably is supplied with heat steam from flash tank 9.

The free transport liquid is conveyed via the return line 15 back to the bottom of the impregnation vessel 1. The free transport liquid contains spent impregnation liquor. Preferably, at least 4 $m^3$/ADT; more preferably at least about 5 $m^3$/ADT of spent impregnation liquor is conducted via the conduit 33 to the recovery unit 16. This spent impregnation liquor has an effective alkaline value (measured as NaOH) that is below 10 grams/liter. More preferred, the effective alkaline value of the spent impregnation liquor is below 8 grams/liter.

The quantity of white liquor that is added at the top of the digester 6 depends on how much white liquor possibly is added else where, but the total amount corresponds to the quantity of white liquor that is required for achieving desired delignification of the wood. Preferably, a major part of the white liquor is added here, i.e., more than 60%, which also improves the diffusion velocity, since it increases in relation to the concentration difference (chip-surrounding liquid). The thoroughly impregnated chips rapidly assimilate the active cooking chemicals by diffusion, since the concentration of alkali (EA as NaOH) is relatively high, at least 20 g/l, preferably between 30 g/l and 50 g/l and more preferred about 40 g/l.

The chips then move down into the concurrent cooking zone B and through the digester 6 at a relatively low cooking temperature, i.e., between about 130–160° C., preferably about 140–150° C. The major part of the delignification takes place in the first concurrent cooking zone B.

The retention time in this first cooking zone should be at least 20 minutes, preferably at least 30 minutes and more preferred at least 40 minutes. The liquid-wood ratio should be at lest 2/1 and should be below 7/1, preferably in the range of 3/1–5.5/1, more preferred between 3.5/1 and 5/1. (The liquid wood-ratio in the counter-current cooking zone C should be about the same as in the concurrent cooking zone B.)

The cooking liquid mingled with released lignin, etc., is drawn off at the draw-off screen 8 into the conduit 28. As mentioned above, liquid finally is also supplied in the lower part of the digester which moves in counter-current. It can be described as the central pipe 14 displacing it from the wood upwards towards the draw-off screen 8. This results, consequently, in the delignification being prolonged in the digester 6.

The temperature in the lower counter-current cooking zone C is preferably higher than the temperature in the concurrent cooking zone B, i.e., preferably exceeding 140° C., preferably about 145–165° C., in order to dissolve remaining lignin. The alkali content in the lowermost part of the counter-current cooking zone should preferably be lower than in the beginning of the concurrent zone, above 5 g/l, but below 40 g/l. Preferably less than 30 g/l and more preferred between 10–20 g/l. In the preferred case, the aim is to have a temperature difference of about 10° C. between the cooking zones. Expediently, the lower circulation 11, 12, 13, 14 is charged with about 5–20%, preferably 10–15%, white liquor. The temperature of the liquid which is recirculated via the central pipe 14 that is regulated with the aid of a heat exchanger 120 so that the desired cooking temperature is obtained at the lowermost part of the counter-current cooking zone C.

In the preferred case, the "cold-blow" process is used so that the temperature of the pulp in the outlet conduit 26 is less than 100° C. Accordingly, washing liquid having a low temperature, preferably about 70–80° C., is added by using the scraping element and an outer annular conduit 25 arranged at the bottom of the digester 6. This liquid consequently displaces the boiling hot liquor in the pulp upwards in counter-current and thereby imparts a temperature to the remaining pulp which can be cold-blown, i.e., depressurized and disintegrated without any real loss of strength.

From tests made in lab-scale, we have found indications that it is desired to keep the alkaline level at above at least 2 g/l, preferably above 4 g/l, in the impregnation vessel in connection with black liquor, which would normally correspond to a pH of about 11. If not, it appears that dissolved lignin precipitate and even condense.

In FIG. 2 there is shown a preferred embodiment of a separator to be used in connection with a steam/vapor phase digester, as described in FIG. 1. It is often preferred to have an upwardly feeding top separator for a steam/liquor-phase digester. The separator may comprise a screen basket 61 in which a rotatable screw feeder 62 is positioned. The screw feeder is fixedly attached to a shaft 63 which at its upper end is fixedly attached to a drive unit 64. The drive unit 64 is attached to a plate 65 which is attached to the digester shell 6.

Circumjacent the screen basket 61 there is arranged a liquid collecting space 67, which may be connected to the return pipe circulation 15. Above the liquid collecting space 67, also circumjacent the screen basket 61, there is arranged a liquid supply space or opening 23 which is connected to the supply line 24 that supplies white liquor. Between the outer peripheral wall 66 of the liquid collecting space 67 and the liquid supply space 23 respectively, and the digester shell 6 at the top, there exist an annular space 70 which opens up down into the upper part of the digester 6. The functioning of the top separator may be described as follows.

The thoroughly heated and impregnated chips are transferred by means of the supply line 21 into the bottom portion of the screen basket 61. Here, the screw feeder 62 moves the chips upwardly at the same time as the transport liquid D is separated from the chips, by being withdrawn outwardly through the screen basket 61 and further out of the digester through return line 15. More and more liquid will be withdrawn from the chips during their transport within the screen basket 61 partly due to the low pressure in the digester. Eventually, the chips reach the level of the supply space 23. Here, the desired amount of cooking liquor, preferably white liquor, is added through the supply space 23, having a temperature and effective alkaline content in accordance with the invention.

In order to eliminate or substantially reduce the risk of back flowing of the supplied liquid from the supply space 23 into the withdrawal space 67, a minor amount of free liquid (at least about 0.5 $m^3$/ADT) should be left together with the chips, which free liquid will then be mixed with the supplied cooking liquor. Preferably, about one m3/ADT should be left together with the fiber material. Additionally, the white liquor should be provided at a point that is downstream of the flow of the suspension of the fiber material and the free liquid that is being fed through the screw member.

At the top of the screen basket 61, the chips and the cooking liquor may flow over the upper edge thereof and fall into the steam vapor space 70 and further on to the top of the chips pile within the digester, where the concurrent cooking zone (B) starts.

Figure 3:
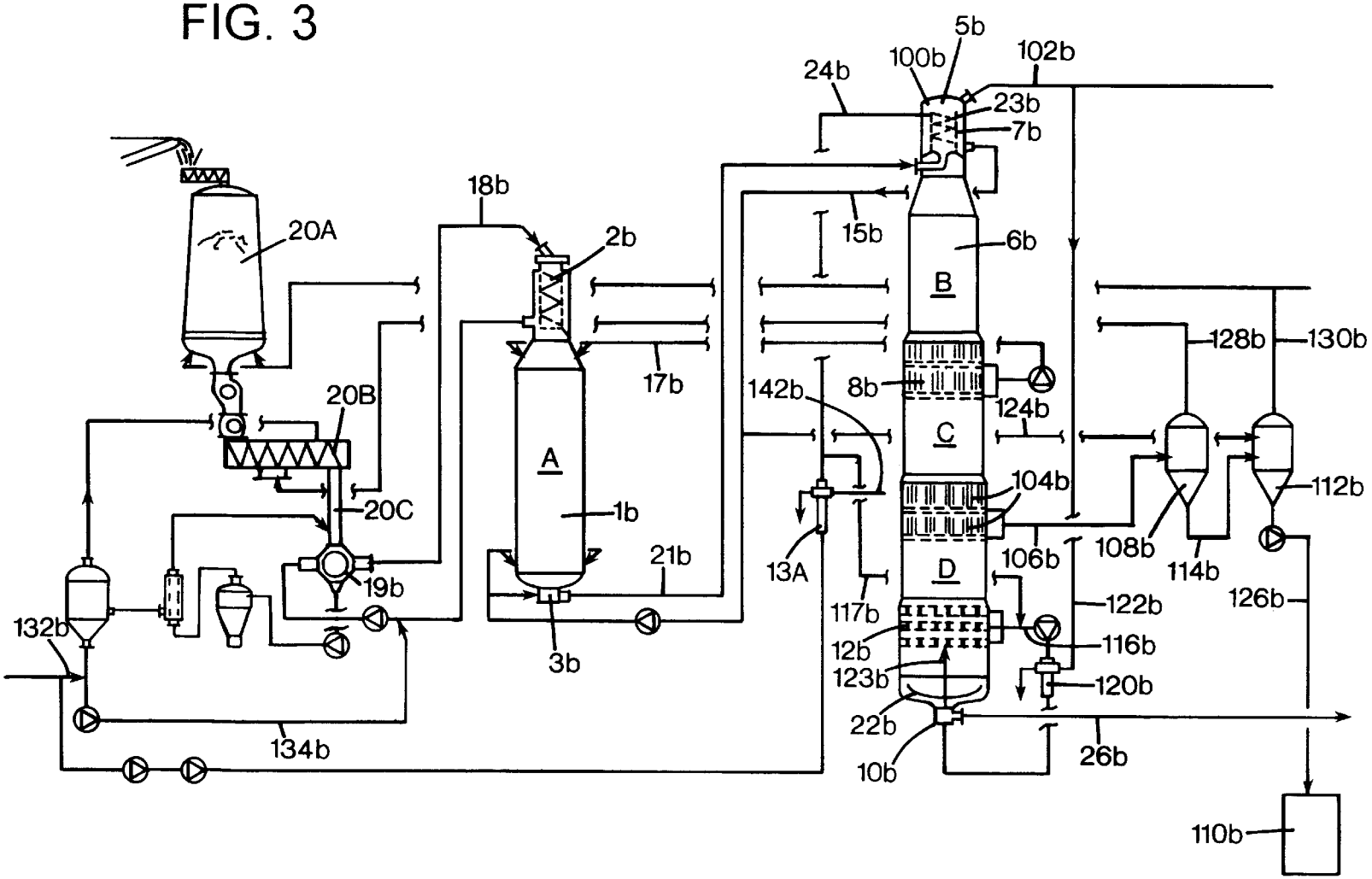
FIG. 3 is a schematic flow diagram of a preferred second embodiment of a digester system according to the present invention.

FIG. 3 shows a preferred second embodiment of the digester system for producing chemical pulp according to the present invention, especially in relation to a retrofit of an MCC digester. The main components of the digesting system consist of an impregnation vessel 1*b* and a steam/liquid-phase digester 6*b*. Some of the more important differences are described herein.

A first screen girdle section 8*b* may be disposed at the upper middle portion of the digester 6*b*. If the digester 6 is an MCC digester, this screen section may be used to withdraw spent liquor that is conducted to a recovery unit. According to the invention, draw-off from this screen girdle section 8*b* may be conducted directly via the conduit 17*b* to the impregnation vessel 1*b*. A second screen girdle section 104*b* may be arranged below the first screen girdle section 8*b* (in an MCC digester, the screen girdle section 104*b* would normally be called the MCC screen). A second concurrent cooking zone C is defined between the sections 8*b* and 104*b*. Draw-off from the second screen section 104*b*, such as spent liquor, i.e., black liquor, may be conducted via a conduit 106*b* to a first flash tank 108*b* to recover steam and let pressure off before the liquor is conducted to a recovery unit 110*b*. Preferably, the spent liquor is also conducted through a second flash tank 112*b* via a conduit 114*b* to further reduce the pressure and temperature of the spent liquor before the liquor is conducted to the recovery unit 110*b*. In the preferred second embodiment, a conduit 124*b* conducts the spent liquor from the return conduit 15*b* (preferably at least 4 $m^3$/ADT; more preferably at least about 5 $m^3$/ADT) to the second flash tank 112*b*. This spent impregnation liquor has an effective alkaline value (measured as NaOH) that is below 10 grams/liter. More preferred, the effective alkaline value of the spent impregnation liquor is below 8 grams/liter. The spent liquor from both flash tanks 108*b*, 112*b* is then conducted with a conduit 126*b* to the recovery unit 110*b*. Conduits 128*b* and 130*b* may be connected to the flash tanks 108*b*, 112*b*, respectively, to supply steam to the chip bin 20A and the steaming vessel 20B.

A third lower screen girdle section 12*b* is disposed at the bottom 10*b* of the digester 6*b*. A counter-current cooking zone D is defined between the sections 12*b* and 104*b*. The girdle section 12*b* may, for example, include three rows of screens for withdrawing liquid, which is heated and to which some white liquor, preferably about 10% of the total amount of the white liquor in conduit 24*b*, is added via a branch conduit 117*b* before it is recirculated by means of a central pipe 123*b*, which opens up at about the same level as the lowermost strainer girdle 12*b*.

The draw-off from screen girdles 12*b* and the white liquor from the branch conduit 117*b* are preferably conducted via a heat exchanger 120*b* back to the bottom 10*b* of the digester 6*b*. The temperature of this draw off is somewhat lower than in the cooking zone D (e.g., about 140° C.), since the liquid is a mix of wash liquid and black liquor. The white liquor is supplied in a counter-current direction via the central pipe 123*b* to the screen girdle section 12*b*. The white liquor provides fresh alkali and, in the form of counter-current cooking, further reducing the Kappa number. A conduit 122*b* is connected to the high pressure steam conduit 102*b* to provide the heat exchanger with steam to regulate the temperature of the liquid supplied via the standpipe 123*b*. A blow line 26*b* is connected to the bottom 10*b* of the digester for conducting the digested pulp away from the digester 6*b*.

A select portion of the installation according to the present invention, as shown in FIG. 3, may function as follows. Some of the more important functional differences compared to the embodiment in FIG. 1 are described below. In the preferred second embodiment, the temperature of the black liquor in the impregnation vessel should be between about 140° C. and about 160° C. More preferred, the temperature is between about 140° C. and about 155° C. Most preferred, the temperature is between about 140° C. and about 150° C.

The retention time in the impregnation zone A should be at least 20 minutes, preferably at least 30 minutes and more preferred at least 40 minutes. However, a shorter retention time than 20 minutes, such as 15–20 minutes may also be used. The volume of the impregnation vessel 1*b* may be larger than 1/11, preferably larger than 1/10 of the volume of the digester 6*b*. Additionally, in the preferred embodiment, the volume V of the impregnation vessel 1 should exceed 5 times the value of the square of the maximum digester diameter, i.e., $V=5D^2$, where D is the maximum diameter of the digester 6*b*.

After the chips have been passed through the top separator, the chips then move down into the concurrent zones B, C through the digester 6*b* at a relatively low cooking temperature, i.e., between 130° C. to 160° C., preferably about 140° C. to 150° C. The major part of the delignification takes place in the first and second concurrent cooking zones B, C.

A further modification would be to have the cooking zone C to be a counter-current zone or a mixture of con/counter-current.)

The temperature in the counter-current zone D is preferably higher than in the concurrent zones B, C, i.e., preferably exceeding 140° C., preferably about 145° C. to 165° C., in order to dissolve remaining lignin. The alkali content in the lowermost part of the concurrent cooking zone C should preferably be lower than in the beginning of the concurrent zone B, above 5 g/l, but below 40 g/l. Preferably less than 30 g/l and more preferred between 10–20 g/l. In the preferred case, the aim is to have a temperature difference of about 10° C. between the first and the second concurrent cooking zones. Expediently, the conduit 116*b* may be charged with about 5–20%, preferably 10–15%, white liquor from the conduit 24*b* via the conduit 117*b*. Below the draw-off screen section 104*b* is the counter-current zone D that is defined between the screen girdle section 104*b* and the screen girdle section 12*b*.

The temperature of the liquid which is recirculated via the pipe 123*b* up to the screen girdle section 12*b* is regulated with the aid of the heat exchanger 120*b* so that the desired cooking temperature is obtained at the lowermost part of the counter-current cooking zone D.

At the lowermost part of the digester, cool wash liquid is added in order to displace, in counter-current, hot liquid which is subsequently withdrawn at the lowermost screen girdle 12*b*.

Figure 4:
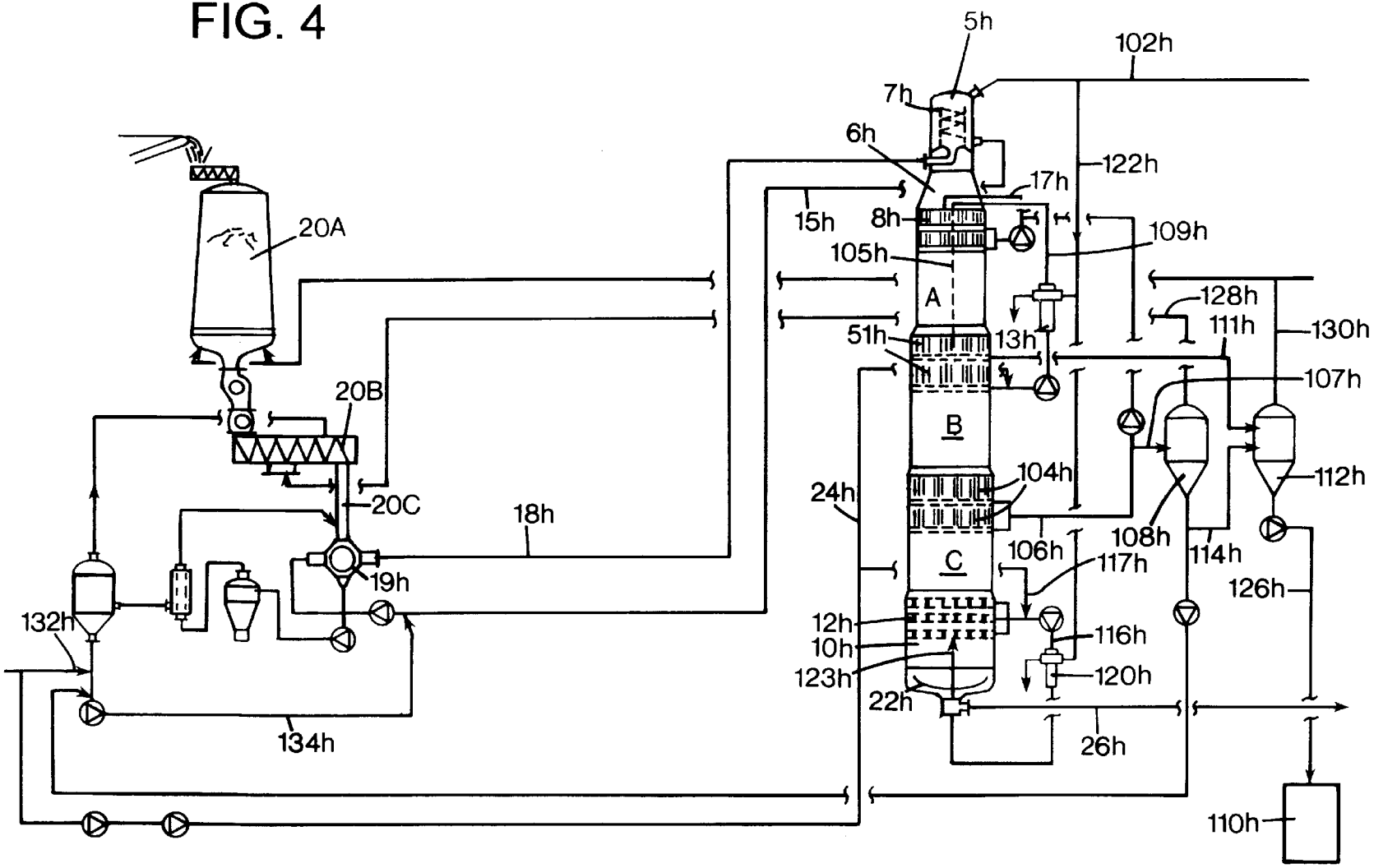
FIG. 4 is a schematic flow diagram of a preferred third embodiment of a digester system according to the present invention.

FIG. 4 illustrates a third embodiment of a digester system of the present invention. This embodiment is a single vessel steam/liquid phase digester system. Some of the important differences compared to FIGS. 1 and 3 are described below. A high-pressure feeder l9*h* feeds the chips suspended in a transport liquid D via a conduit 18*h* to the top of a digester 6*h*.

The conduit 18*h* extends from the feeder 19*h* up to a top 5*h* of the digester 6*h*. The conduit 18*h* may open up at the bottom of a top separator 7*h* that feeds by means of a screw in an upwardly moving direction. The separator 7*h* is preferably identical or very similar to the top separator 7 that is shown in FIG. 1 and described in detail above. The screen of the separator may be used to draw off the transport liquid D (which is then returned in a return line 15*h*) together with which the chips are transported from the feeder 19*h* up to the top 5*h* of the digester 6*h*. A first screen girdle section 8*h* may be disposed immediately below or adjacent the separator 7*h*. A recirculation line 17*h* may withdraw liquor and bring it back to a space that is defined between the first screen girdle section 8*h* and the separator 7*h*. The recirculation improves the distribution of the liquor in the digester.

A second screen girdle section 51*h* is disposed below the first screen girdle section 8*h* so that an impregnation zone A is defined between the screen girdle sections 8*h* and 51*h*. We have found indications that it is desirable to keep the alkaline level at above at least 2 g/l, preferably above 4 g/l, in the impregnation zone A in connection with black liquor, which would normally correspond to a pH of about 11. If not, it appears that dissolved lignin precipitate and even condense. Spent liquor may be withdrawn from the upper screen of the section 51*h* and conducted with a conduit 111*h* to a second flash tank 112*h*. Spent liquor is withdrawn via a conduit 109*h* from a lower screen of the section 51*h* and conducted back to the space defined above the first screen girdle section 8*h* so that the spent liquor may be reintroduced back to the lower screen of the second screen girdle section 51*h* via a central pipe 105*h*. The temperature of the spent liquor may be controlled by a heat exchanger 13*h*. The heat exchanger 13*h* is in operative engagement with a high pressure steam line 102*h* via a conduit 122*h*.

A cooking liquor conduit 24*h* is operatively attached to the conduit 109*h* to supply a cooking liquor, such as white liquor, to the conduit 109*h*. The effective alkali of the liquor in the conduit 109*h* is at least about 35 g/l; more preferably at least about 40 g/l; and, most preferably, between about 45 g/l and about 55 g/l.

Approximately 95% of the total supply of the white liquor in conducted in the conduit 24*h* and the remaining 5% is supplied to the high pressure feeder 19*h* via a conduit 132*h* and a conduit 134*h* to lubricate the high pressure feeder 19*h*.

A third screen girdle section 104*h* may be arranged below the second screen girdle section 51*h* so that a concurrent cooking zone B is defined between the screen girdle sections 51*h* and 104*h*. Draw-off from the third screen section 104*h*, such as spent liquor, i.e., black liquor, may be conducted via a conduit 106*h* back to the conduit 17*h*. The effective alkali of the spent liquor conducted in the conduit 106*h* is about 13 g/l or more. A minor portion of the black liquor in the conduit 106*h* may be conducted to a first flash tank 108*h* via a conduit 107*h* to cool the spent liquor before the liquor is conducted to a recovery unit 110*h*. Preferably, the spent liquor is also conducted through a second flash tank 112*h* via a conduit 114*h* to further reduce the temperature and pressure of the spent liquor before the liquor is conducted to the recovery unit 110*h*. The spent liquor from both flash tanks 108*h*, 112*h* are then conducted with a conduit 126*h* to the recovery unit 110*h*. Conduits 128*h* and 130*h* may be connected to the flash tanks 108*h*, 112*h*, respectively, to provide steam that is sent to the chip bin 20A and the steaming vessel 20B.

At a bottom 10*h* of the digester 6*h*, there is a feeding-out device including a scraping element 22*h*. A fourth lower screen girdle section 12*h* is disposed at the bottom 10*h* of the digester 6*h* so that a concurrent cooking zone C is defined between the sections 104*h* and 12*h*. The girdle section 12*h* may, for example, include three rows of screens for withdrawing liquid, which is heated and to which some white liquor, preferably about 10% of the total amount of the white liquor in the conduit 24*h*, is added via a branch conduit 117*h* before it is recirculated by means of a central pipe 123*h*, which opens up at about the same level as the lowermost strainer girdle 12*h*.

The draw-off from screen girdles 12*h* and the white liquor from the branch conduit 117*h* are preferably conducted via a heat exchanger 120*h* back to the bottom 10*h* of the digester 6*h*. The conduit 122*h* is connected to the heat exchanger 120*h* to provide the heat exchanger 120*h* with steam to regulate the temperature of the white liquor in the conduit 116*h*. The temperature of this draw off is normally about 130° C. to 140° C. The white liquor is supplied in a counter-current direction via the central pipe 123*h* to the screen girdle section 12*h*. The white liquor provides fresh alkali and, in the form of counter-current cooking, further reducing the kappa number. A blow line 26*h* may be connected to the bottom 10*h* of the digester for conducting the digested pulp away from the digester 6*h*.

A preferred installation according to the present invention, as shown in FIG. 4, may be described as follows. The chips are fed into the chip bin 20A and are subsequently steamed in the vessel 20B and, thereafter, conveyed into the chute 20C. The high-pressure feeder 19*h*, which is supplied with a minor amount of white liquor (approximately 5% of the total amount to lubricate the feeder), feeds the chips into the conduit 18*h* together with the transport liquid. The slurry of chips and the liquid are fed to the top of the digester 6*h* and may have a temperature of about 110–120° C. when entering the digester 6*h* (excluding recirculated transport liquor).

Inside the top of the digester 6*h*, there is the top separator 7*h* that pushes chips in an upward direction through the separator and then the chips move slowly downwards in a plug flow through the impregnation zone A in a liquid/wood ratio between 2/1–10/1 preferably between 3/1–8/1, more preferred of about 4/1–6/1. The liquor, which is drawn off from the screen girdle section 8*h*, may be recirculated via the conduit 17*h* to the space below the top separator 7*h*. The chips are then thoroughly impregnated in the impregnation zone A.

A spent liquor is withdrawn at the upper segment of the screen section 51*h* and conducted to the second flash tank 112*h*. A spent liquor is also withdrawn at the lower segment of the section 51*h* and reintroduced via the central pipe 105*h* with the addition of white liquor supplied by the conduit 24*h*.

The chips move down in the concurrent zone B through the digester 6*h* at a relatively low cooking temperature, i.e., between 130–160° C., preferably about 140–150° C. The major part of the delignification takes place in the first concurrent cooking zone B.

The temperature in the lower counter-current zone C is preferably higher than in the concurrent zone B, i.e., preferably exceeding 140° C., preferably about 145–165° C., in order to dissolve remaining lignin. The alkali content in the lowermost part of the counter-current cooking zone C should preferably be lower than in the beginning of the concurrent zone B, above 5 g/l, but below 40 g/l. Preferably less than 30 g/l and more preferred between 10–20 g/l. In the preferred case, the aim is to have a temperature difference of about 10° C. between the concurrent zone B and the counter-current cooking zone C. Expediently, the conduit 116*h* may be charged with about 5–20%, preferably 10–15%, white liquor from the conduit 24*h* via the conduit 117*h*.

The temperature of the liquid which is recirculated via the pipe 123*h* up to the screen girdle section 12*h* is regulated with the aid of the heat exchanger 120*h* so that the desired cooking temperature is obtained at the lowermost part of the counter-current cooking zone.

Figure 5:
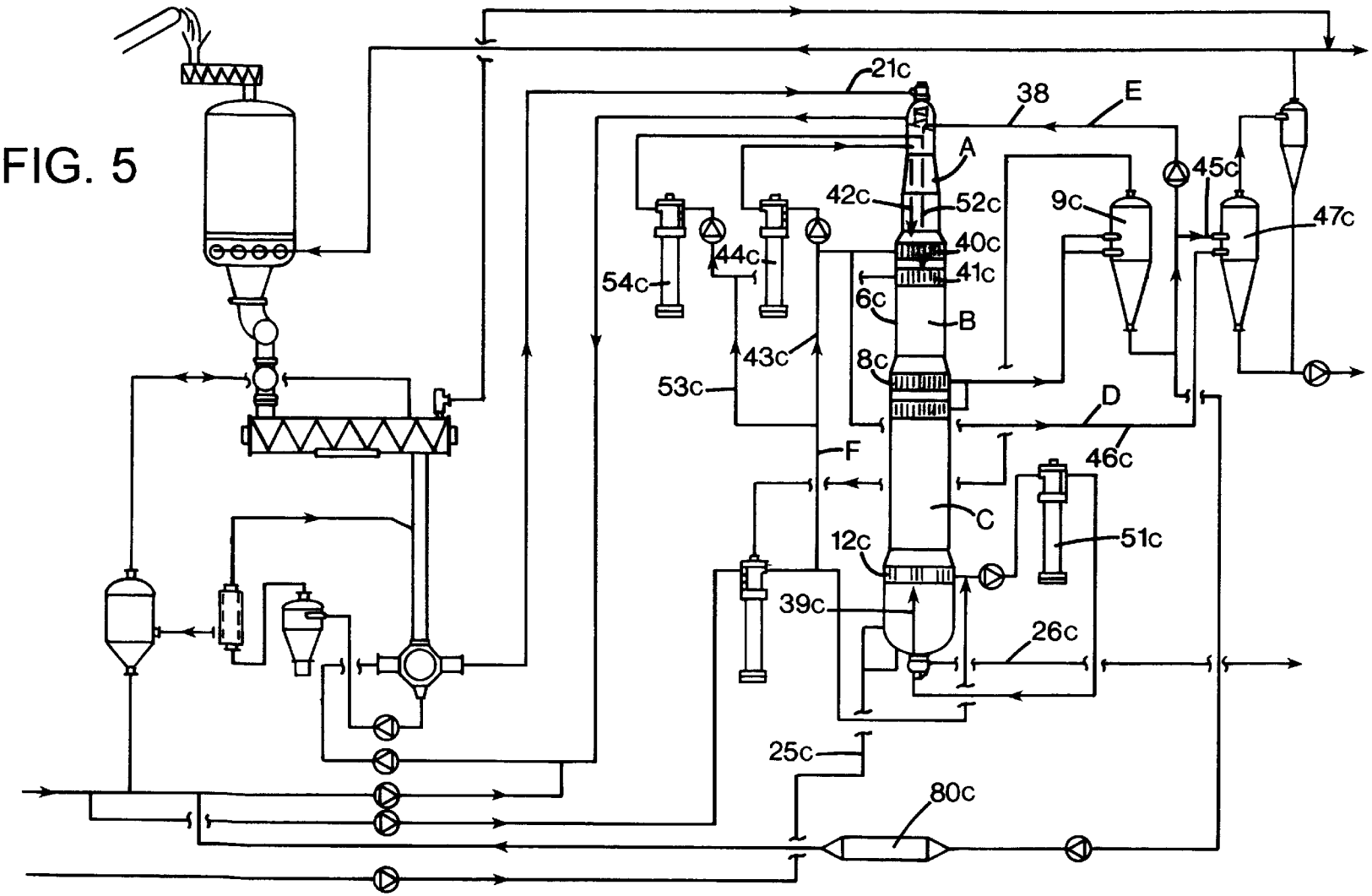
FIG. 5 is a schematic flow diagram of a preferred fourth embodiment of a digester system according to the present invention.

In FIG. 5, it is shown a preferred embodiment for applying the invention to a single vessel hydraulic digester. The same kind of basic equipment before and in connection with the HP-feeder as shown in FIG. 1 is used, which therefore is not described in detail. Withdrawal strainers 8*c* are arranged in the middle part of the digester. The lowermost part of the digester is in principle similar to the one shown in FIG. 1, with a supply line 25*c* for washing liquid and a blow line 26*c* for removing the digested pulp from the digester 6*c*. A short distance above the bottom of the digester 6*c*, there is positioned a strainer arrangement 12*c* for withdrawing liquid which is heated and to which some white liquor, preferably about 10% of the total amount, is added before it is recirculated by means of a stand pipe 39*c*, which opens up at about the same level as the lowermost strainer girdle 12*c*.

In the upper part of the digester there are arranged two further strainer sets 40*c*, 41*c*. The upper strainer 40*c* is arranged for withdrawing liquid which has passed the impregnation zone (A). Some of the withdrawn liquid D is taken out via a conduit 46*c* to a second flash tank 47*c*. The other part of the withdrawn liquid is recirculated for re-introducing liquid withdrawn by means of a central pipe 42*c* which opens up at a level adjacent the strainer 40*c*. Before the liquor withdrawn from the strainer 40*c* is re-introduced, white liquor can be added thereto by means of a supply-line 43*c* and thereafter the liquid is heated to the desired temperature by means of a heat exchanger 44*c*.

The second strainer 41*c*, which is positioned immediately below the upper strainer 40*c* but above the withdrawal strainer 8*c* is a also part of a re-circulation unit. The liquor that is withdrawn from the strainer 41*c* is recirculated for re-introducing the liquor by means of a central pipe 52*c* which opens up at a level adjacent the strainer 41*c*. Before the liquor withdrawn from the strainer 41*c* is re-introduced, the main portion of the white liquor is added thereto by means of a supply-line 53*c* and thereafter the liquid is heated to the desired temperature by means of a heat exchanger 54*c*.

The digesting process within a digester shown in FIG. 5 may be described as follows. The slurry of chips and transport liquid is transferred, e.g., by means of high pressure feeder, within the feeding line 21*c* to the top of the digester where it is introduced into the top of the screen basket 35*s* (see FIG. 6) of the separator, wherein the major part of transport liquid is separated from the chips. At the lower end 37*s* of the separator impregnation liquor E is supplied by means of a supply line 38*c*. The impregnation liquor is hot black liquor that is taken from the withdrawal screen 8*c* via a flash tank 9*c* by means of the supply conduit 38*c*.

If all the desired amount cannot be withdrawn via the conduit 46*c* to the flash tank 47*c*, there is provided for the possibility of also withdrawing from the outlet of the first flash tank 9*c* via a conduit 45*c*. A minor amount of the black liquor withdrawn from flash tank 9*c* may be used for transferring the chips from the HP-feeder to the inlet of the digester 6*c*. This minor flow then has to be cooled in a cooler 80*c* before it is entered into the feeder. The two flows of black liquor are preferably used to regulate the temperature within the impregnation zone A. In the preferred embodiment, the temperature of the black liquor within the impregnation zone is preferably between about 140° C. and about 160° C. More preferred, the temperature is between about 140° C. and about 155° C. Most preferred, the temperature is between about 140° C. and about 150° C.

The amount of effective alkaline of the black liquor provided in the conduit 38*c* is relatively high, at least 13 g/l, preferably about 20 g/l, which provides for the impregnation zone (A) to be established without any substantial additional supply of white liquor at this position. The chips are then impregnated and heated when moving down towards the upper screen 40*c*, where the spent liquor (D) is withdrawn and transferred by means of the conduit 46*c* to the flash tank 47*c*.

The chips are heated and alkali is introduced by means of the above described cooking circulations 40*c*, 42*c*, 43*c*, 44*c*; and 41*c*, 52*c*, 53*c* and 54*c* in order to obtain the desired cooking conditions. In the preferred mode, the temperature at the beginning of the concurrent zone B is about 145–160° C. for soft wood and about 140–155° C. for hard wood and an alkaline content of about 30–50 g/l. Thanks to the exothermic reaction of the chemicals, the temperature is slightly further increased when the fiber material is moving downwardly in the concurrent cooking zone B.

Liquid having a relatively high content of effective alkaline is withdrawn at the strainers 8*c* positioned adjacent the middle section of the digester 6*c*. The alkaline content of this withdrawn spent liquor E would normally exceed 15 g/l.

Also liquor from the counter-current zone C is withdrawn at this withdrawal strainer 8*c*, since the liquor being introduced by means of the stand pipe 39*c* moves in counter-current upwardly through the concurrent cooking zone C finally reaching these strainers 8*c*. In the counter-current zone C, preferably, a higher temperature is maintained than in the concurrent zone B. This is achieved by means of heating the liquid drawn from the lower withdrawal strainer 12*c*, in a heat exchanger 51*c* before introducing it through the stand pipe 39*c*. In the preferred case, also a minor amount, about 10–15% of the total amount, of white liquor is added to this recirculation line to achieve the desired alkali concentration in the counter-current cooking zone C.

The pulp is then cooled by means of washing liquid 25*c* that is supplied at the bottom of the digester. The washing liquid moves in counter-current upwardly and subsequently is withdrawn at the strainer 12*c*. The cooled finally digested pulp, is then taken out of the digester into the blow-line 26*c*.

As already mentioned, pulp produced in this manner has a higher quality and better bleachability than pulp produced with known methods. In lab-scale tests, we have found that about 10 kg of active chlorine can be saved for reaching full brightness (about 90% ISO), compared to a conventionally cooked pulp.

Figure 6:
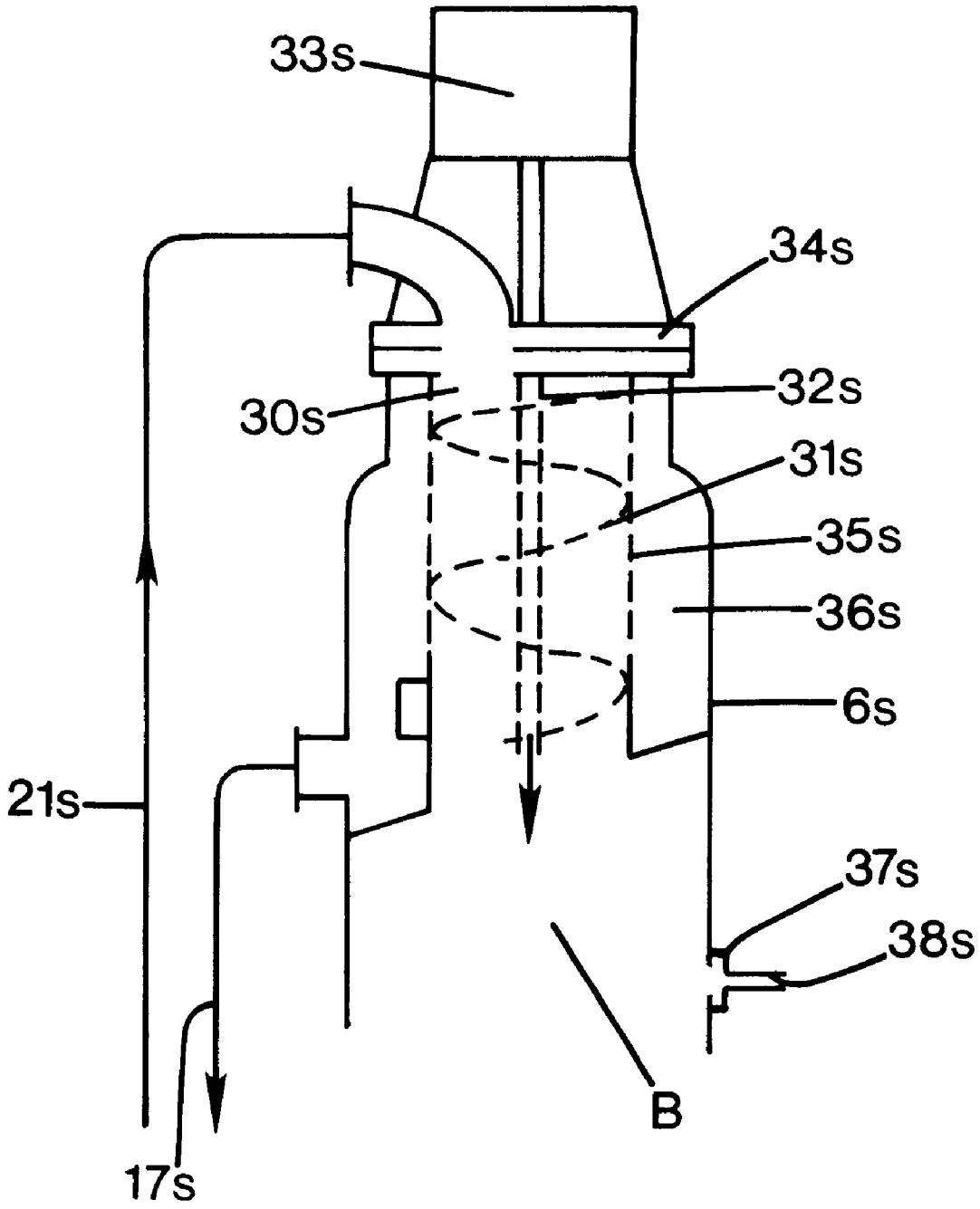
FIG. 6 is a cross-sectional view of a preferred top separator to be used in an hydraulic digester according to the present invention.

In FIG. 6, there is shown a separation device intended for a hydraulic digester according to the present invention. Only a part of the top of the digester 6*s* is shown. The slurred fiber material is transferred to the top of the digester by means of a transfer line 21*s* and enters an in-let space 30*s* of a screw-feeder 31*s*. The screw-feeder 31*s* is attached to a shaft 32*s* connected to a drive-unit 33*s* which is attached to a mounting-plate 34*s* on the top of the digester shell 6*s*. The drive-shaft 32*s* is rotated in a direction so as to force the screw to feed in a down-ward direction.

A cylindrical screen-basket 35*s* surrounds the screw-feeder 31*s*. The screen-basket 35*s* is arranged within the digester shell 6*s* so as to form a liquid collecting space 36*s* between the digester shell and the outer surface of the screen-basket 35*s*. The liquid collecting space 36*s*, which preferably is annular, communicates with a conduit 15*s* for withdrawing liquid from the liquid collecting space 36*s*, which in turn is replenished by liquid from the slurry within the screen basket 35*s*. The major part of the free liquid within the slurry entering the screen basket is withdrawn into the liquid collecting space 36*s*, but a small portion of free liquid, at least about 0.5 $m^3$/ADT should not be withdrawn from the slurry.

Below the outlet end of the screen basket 35*s* there is arranged a pair of liquid supply devices 37*s*, each preferably comprising an annular distribution ring which opens up into the chips pile for supply of liquid into the fiber material moving down into the digester 6*s*. The liquid supply devices 37*s* are replenished by means of lines 38*s* wherein a desired amount of liquid is supplied. If it is a two-vessel hydraulic digester system, the liquid supplied through the liquid supply devices 37*s* would be hot cooking liquor having a relatively high amount of effective alkaline, in order to provide for the possibility of establishing a concurrent cooking zone B having a desired temperature of about 145–150° C., and a desired content of effective alkaline, e.g., about 45 g/l.

A major advantage of the shown separation devices is that they provide for establishing a distinguished change of zones (they enable almost a total exchange of free liquid at this point), which means that for a two vessel system the desired conditions in the beginning of the concurrent zone (B) can easily be established.

Figure 7:
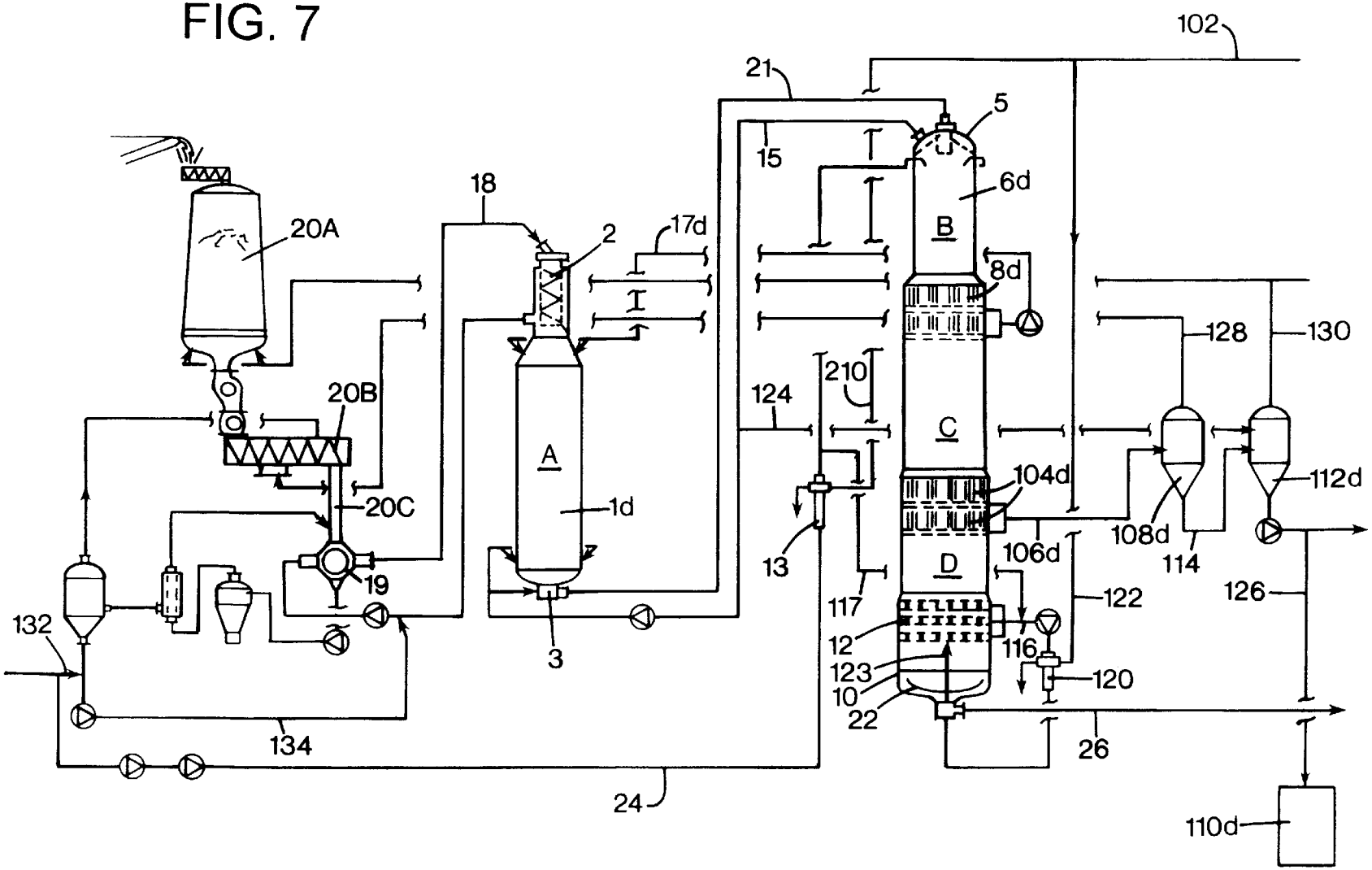
FIG. 7 is a schematic flow diagram of a preferred fifth embodiment of a digester system according to the present invention.

FIG. 7 shows a preferred fifth embodiment of the digesting system of the present invention. In particular, the digesting system is a two vessel hydraulic digester system. The fifth embodiment is very similar to the second embodiment except that the digester 6*d* is a hydraulic digester so that the digester has a downwardly feeding top separator, as shown in FIG. 6. The rest of the digesting system is virtually identical to the second embodiment. If the digester 6*d* is an MCC digester, the screen section 8*d* may be used to withdraw spent liquor that is conducted to a recovery unit. Draw-off from this screen girdle section 8*d* can also be conducted directly via the conduit 17*d* to the impregnation vessel 1*d*. A second screen girdle section 104*d* may be arranged below the first screen girdle section 8*d* (in an MCC digester, the screen girdle section 104*d* would normally be called the MCC screen). Draw-off from the second screen section 104*d*, such as spent liquor, i.e., black liquor, may be conducted via a conduit 106*d* to a first flash tank 108*d* to recover steam and let pressure off before the liquor is conducted to a recovery unit 110*d*, as described in the second embodiment.

Figure 8:
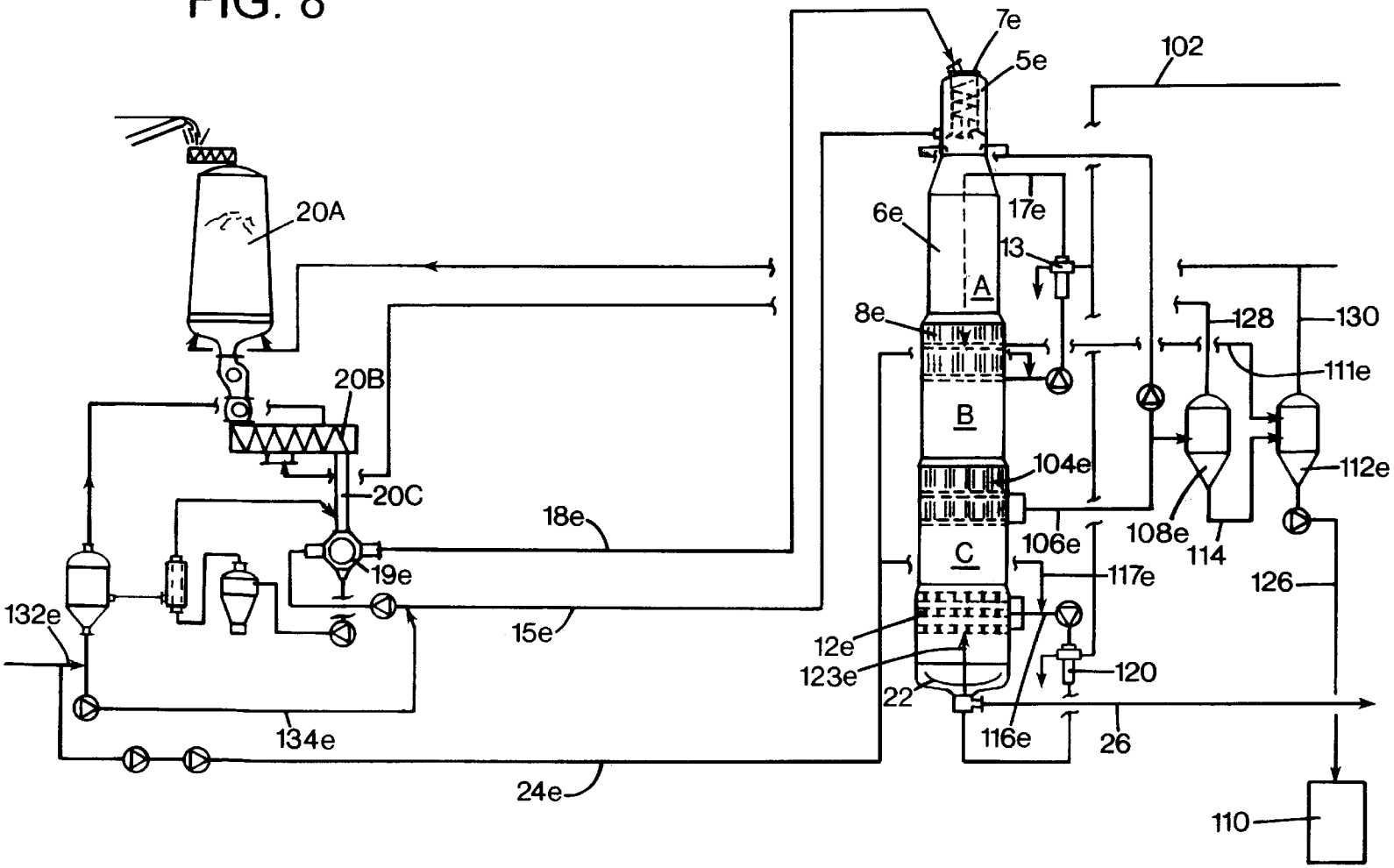
FIG. 8 is a schematic flow diagram of a preferred sixth embodiment of a digester system according to the present invention.

FIG. 8 illustrates a sixth embodiment of the digesting system of the present invention. More particularly, the digesting system is a single vessel hydraulic digester system only the significant differences between this embodiment and the embodiments described earlier are detailed below.

A high-pressure feeder 19*e* feeds the chips suspended in a transport liquid D via a conduit 18*e* to the top of a digester 6*e*. The conduit 18*e* may open up at the top of a top separator 7*e* that feeds by means of a screw in a downwardly moving direction. The separator 7*e* is preferably identical or very similar to the top separator 7*s* that is shown in FIG. 6 and described in detail above. The screen of the separator may be used to draw off the transport liquid D (which is then returned in a return line 15*e*) together with which the chips are transported from the feeder 19*e* up to the top 5*e* of the digester 6*e*. A first screen girdle section 8*e* may be arranged in conjunction with a step-out approximately in the middle of the digester 6*e*. Draw-off of spent liquor from a lower portion of the screen girdle section 8*e* may be conducted via the conduit 17*e* to an impregnation zone A that is defined between the screen girdle section 8*e* and the top 5*e* of the digester 6*e*. The spent liquor that is withdrawn from an upper portion of the screen girdle section 8*e* may be conducted via a conduit 111*e* to a second flash tank 112*e*.

A cooking liquor conduit 24*e* is operatively attached to the conduit 17*e* to supply a major part of the cooking liquor, such as white liquor, to the conduit 17*e*. The effective alkali of the liquor in the conduit 17*e* is at least about 35 g/l; more preferably at least about 40 g/l; and, most preferably, between about 45 g/l and about 55 g/l.

Approximately 95% of the total supply of the white liquor in conducted in the conduit 24*e* and the remaining 5% is supplied to the high pressure feeder 19*e* via a conduit 132*e* and a conduit 134*e* to lubricate the high pressure feeder 19*e*.

A second screen girdle section 104*e* may be arranged below the first screen girdle section 8*e*. Draw-off from the second screen section 104*e*, such as spent liquor, i.e., black liquor, may be conducted via a conduit 106*e* back to a top portion of the impregnation zone A. The effective alkali of the spent liquor conducted in the conduit 106*e* is about 10–20 g/l. A portion of the black liquor in the conduit 106*e* may be conducted to the flash tanks as described in the earlier embodiments. At the bottom of the digester there is a screen girdle section 12*e* for drawing off a spent liquor. The temperature of this draw off is about 130–150° C. The temperature may depend on how much washing-liquid that has penetrated to the screen is withdrawn. The white liquor is supplied in a counter-current direction via a central pipe 123*e* to the screen girdle section 12*e*.

A major portion of the black liquor may directly (or via one flash tank) be fed into the impregnation zone A. The total supply of black liquor to the impregnation zone A may exceed 80% of the amount drawn off from a draw-off screen girdle section 104*e*, preferably more than 90% and optimally about 100% of the total flow, which normally is about 8–12 $m^3$/ADT.

The chips then move down in the concurrent zone B through the digester 6*e* at a relatively low cooking temperature, i.e., between 130–160° C., preferably about 140–150° C. The major part of the delignification takes place in the first concurrent cooking zone B.

The temperature in the lower counter-current zone C is preferably higher than in the concurrent zone B, i.e., preferably exceeding 140° C., preferably about 145–165° C., in order to dissolve remaining lignin. The alkali content in the lowermost part of the counter-current cooking zone C should preferably be lower than in the beginning of the concurrent zone B, above 5 g/l, but below 40 g/l. Preferably less than 30 g/l and more preferred between 10–20 g/l. In the preferred case, the aim is to have a temperature difference of about 10° C. between the concurrent zone B and the counter-current cooking zone C. Expediently, the conduit 116*e* may be charged with about 5–20%, preferably 10–15%, white liquor from the conduit 24*e* via the conduit 117*e*.

Figure 9:
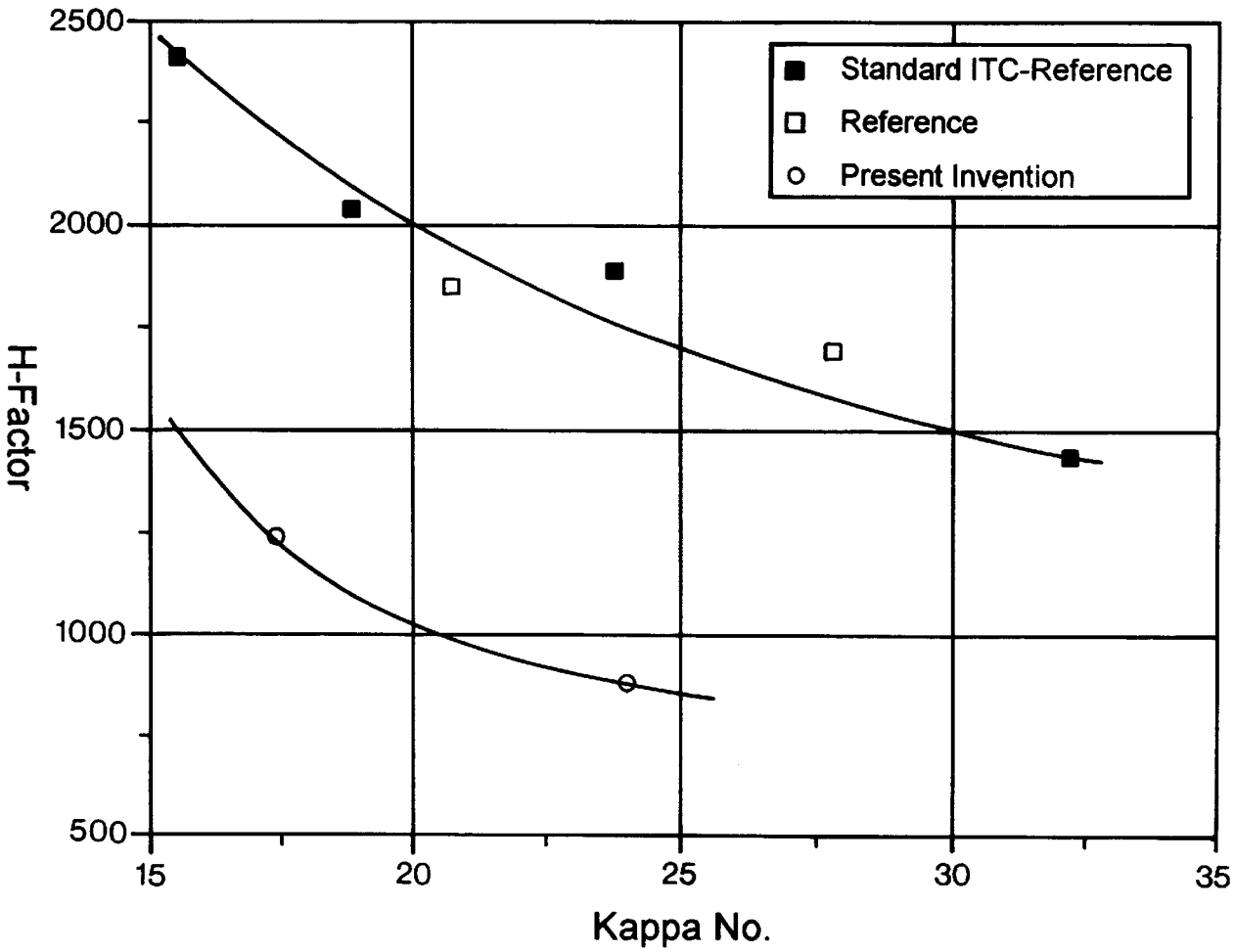
FIG. 9 shows a diagram presenting the advantages related to the H-factor when using the invention.

In FIG. 9, there is shown a diagram comparing the H-factor for pulp produced according to conventional ITC™-cooking and the invention. The H-factor is a function of time and temperature in relation to the delignification process (degree of delignification) during cooking. The H-factor is used to control the delignification process of a digester, i.e., maintaining a certain H-factor principally leads to the same Kappa number of the produced pulp (remaining lignin content of the fiber material) independent of temperature variations during the cooking.

In FIG. 10 it is shown that the H-factor for pulp produced according to the invention is extremely much lower (about 40–50% lower) compared to pulp produced according to ITC™. This means that much lower temperatures may be used for the same retention time in order to reach a certain degree of delignification (Kappa number) and/or that smaller vessels for the cooking within a continuous digester can be used and/or that a lower Kappa number may be achieved with the same kind of basic equipment and/or that higher rate of production can be obtained.

The lower H-factor demand is achieved by a high alkali concentration and a low cooking temperature in the concurrent cooking zone which presents one reference ITC-cook (ITC 1770) and one cook according to the invention (modified ITC* 1763). As shown the temperature in the counter-current cooking zone, according to the invention, is higher than in the concurrent zone but still lower than the temperature in the counter-current zone in the ITC-reference.

Figure 11:
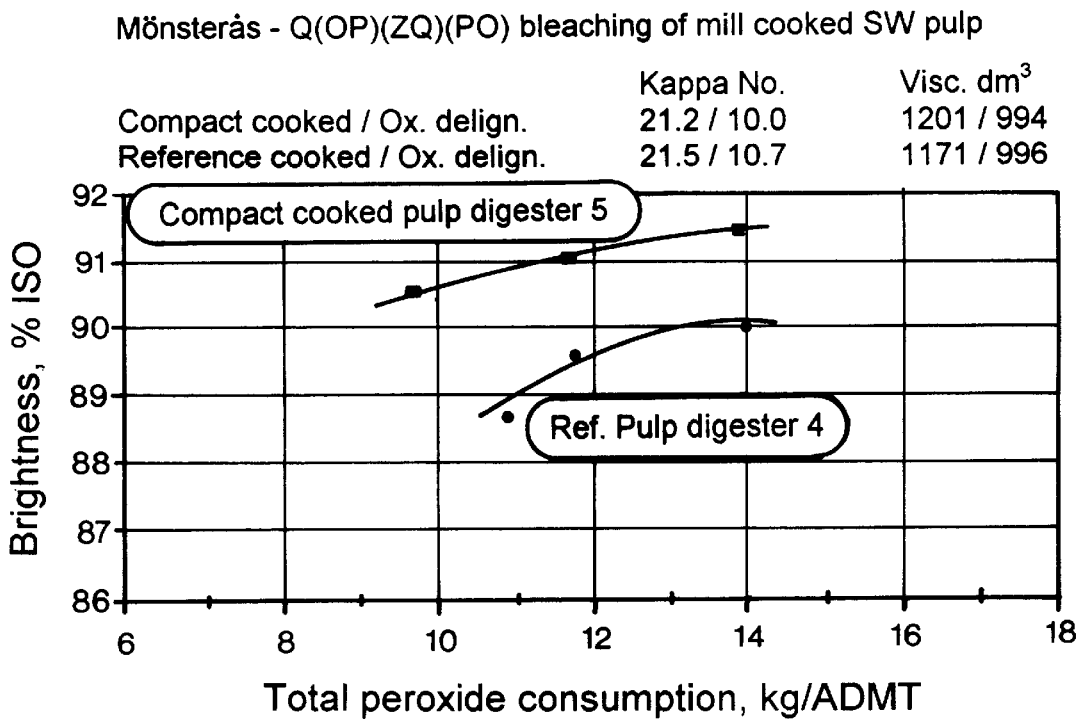
FIG. 11 shows test data related to peroxide consumption and brightness for the present compact method compared to a conventional process.

FIG. 11 shows results from TCF bleaching using the cooking process (so called "compact cooking") of the present invention compared to a conventional reference cooking process. The present invention provides a TCF-bleached pulp having extremely good bleachability—a higher brightness is achieved compared to the conventional process for the same amount of peroxide consumption, and also a higher brightness ceiling is obtained.

Figure 12:
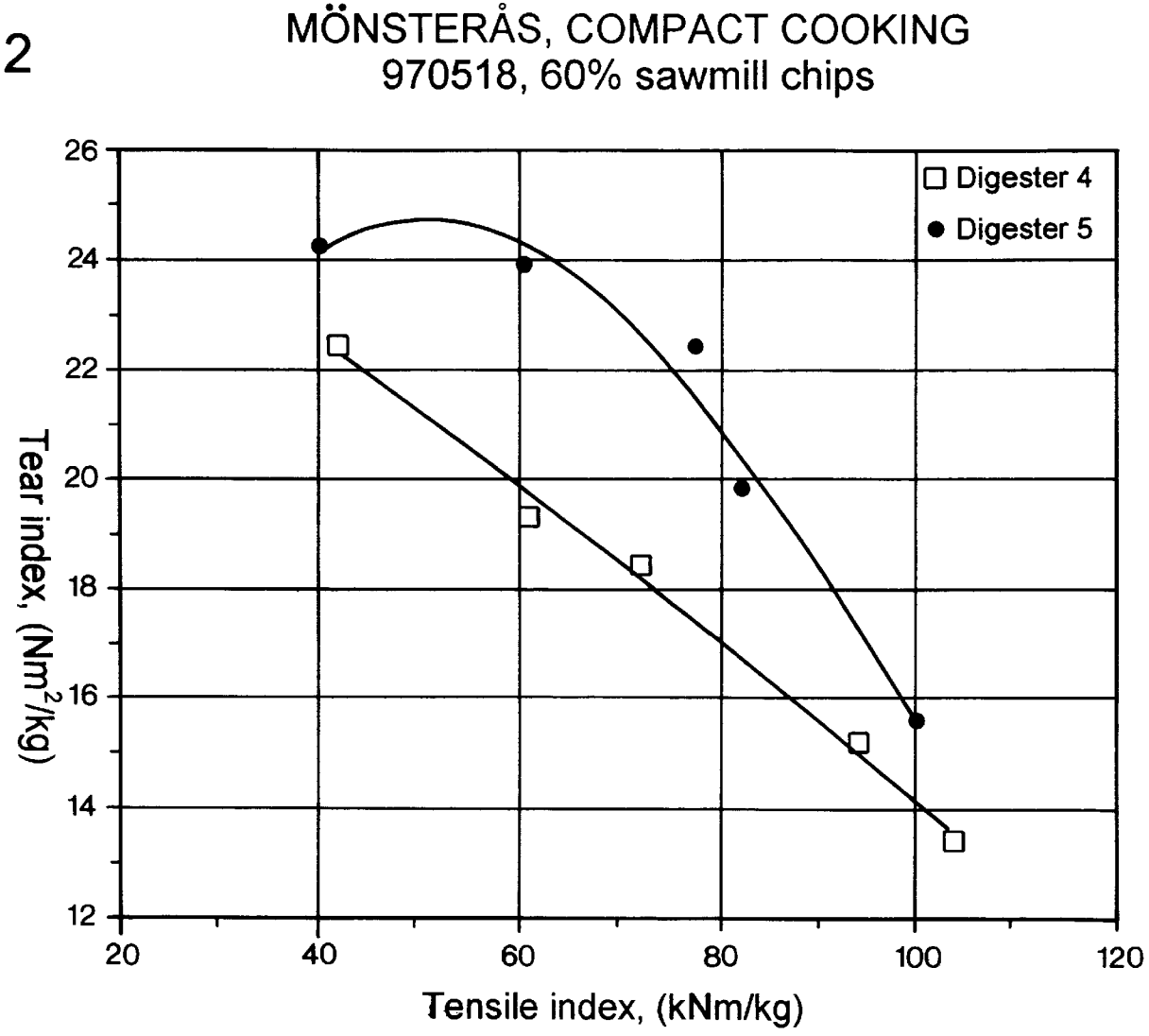
FIG. 12 shows test data related to tensile index and tear index for the present compact method compared to a conventional process.

FIG. 12 shows the tear index relative to the tensile index. The test data that are related to the digester 5 are using the cooking process of the present invention and the conventional cooking process was using in the digester 4.

Figure 13:
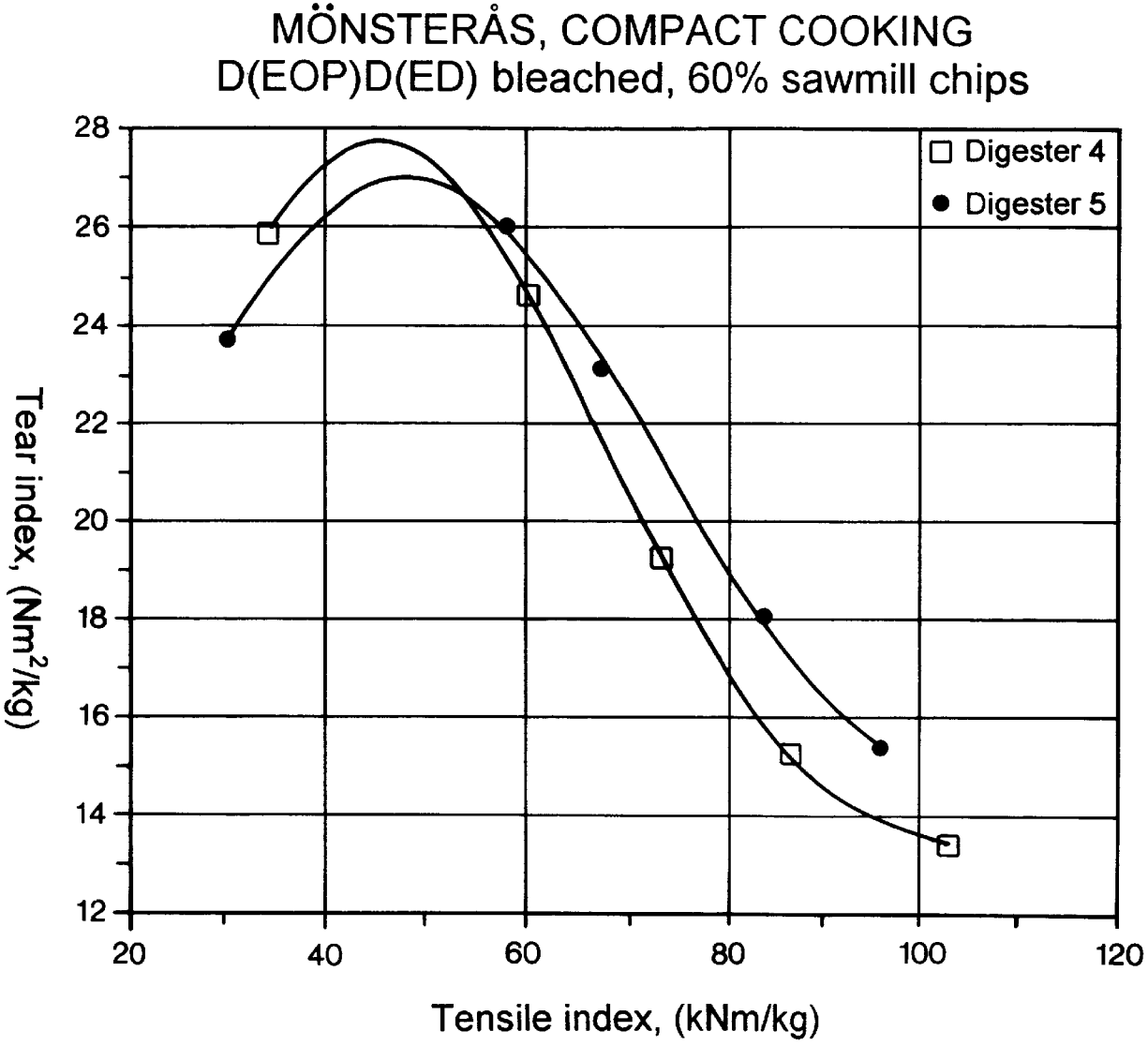
FIG. 13 shows test data related to tensile index and tear index for the present compact method compared to a conventional process.

Similarly, FIG. 13 illustrates test data for the digester 5 (the present invention) and the digester 4. The present invention exhibits better tensile index compared to the conventional method used in the digester 4.

Figure 14:
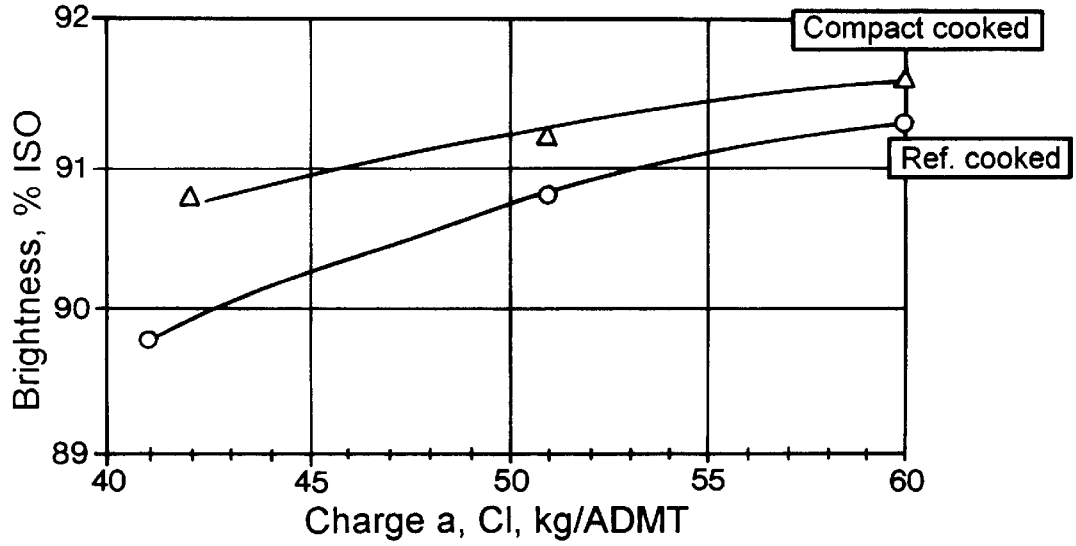
FIG. 14 shows test data related to Cl charge and brightness for the present compact method compared to a conventional process.

FIG. 14 shows the brightness level by using compact cooked (the present invention) and reference cooked pulp (conventional process). The cooking process of the present invention exhibits a higher brightness compared to the conventional cooking process.

Figure 15:
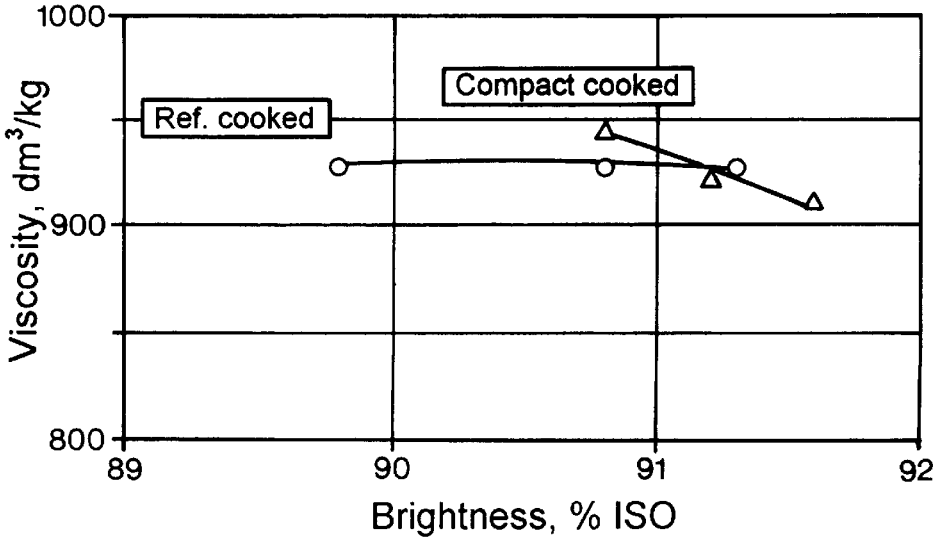
FIG. 15 shows test data related to brightness and viscosity for the present compact method compared to a conventional process.

Similarly, FIG. 15 shows the brightness level relative to the viscosity of the pulp by using the cooking process of the present invention (compact cooked) compared to a conventional process (reference cooked). It can be seen that the invention provides a pulp having a higher viscosity at the same brightness.

The invention is not limited to that which has been shown above but can be varied within the scope of the subsequent patent claims. Thus, instead of the shown separator used with the hydraulic digester many alternatives may be used, e.g., instead of an annular supply arrangement a central pipe (as shown in WO-9615313) for supply of liquid at distance downstream of the separator device within chip pile adjacent the top of the digester.

Moreover there are many ways of optimizing the conditions even further, e.g., new on-line measuring systems (for example using NIR-spectroscopy) provide for the possibility of exactly measuring specific contents of the fibre material and the liquids entering the digesting system, which will make it feasible to more precisely determine and control the supply/addition of specific fluids/chemicals and also their withdrawal in order to establish optimized conditions. Different kind of additives can be very beneficial to use, especially for example poly-sulphide which has a better effect in a low temperature environment than in high temperatures. Also AQ (Anthraquinone) would be very beneficial since it combines very well with high alkaline environments.

Furthermore, there are a multiplicity of alternatives for uniformly drenching the chips with white liquor at the top of the digester. For example, a centrally arranged inlet (as described in WO-having a spreading device can be contrived, which device, in a known way, provides a mushroom-like film of liquid, as can a centrally arranged showering element or an annular pipe with slots, etc.

In addition, the number of screen girdles shown is in no way limiting for the invention but, instead, the number can be varied in dependence on different requirements. The invention is in no way limited to a certain screen configuration and it is understood that bar screens can be exchanged by, for example, such as screens having slots cut out of sheet metal. Also in some installations moveable screens are preferred.

Furthermore, in order to amplify the heat economy, measures can be taken which decrease heat losses from the digester, such as, for example, insulation of the digester shell and/or maximization of the volume in relation to the outwardly exposed surface, i.e., increasing the cross-sectional area.

The shown system in front of the digester is in no way limiting to the invention, e.g., it is possible to exclude the steaming vessel 20 and have a direct connection between the chip bin (for example, a partly filled atmospheric vessel) and the chip chute. Furthermore, other kind of feeding systems than an HP-feeder may be used, e.g., DISCFLO™-pumps).

In order to improve the distribution of the white liquor added at the top, it is possible to install a so called "quench circulation" which would recirculate a desired amount of liquid from below the top screen 7 back to the annular pipe 23. For this purpose ordinary screens is not a requirement. Finally, it should be understood that the basic principle of the invention can be applied also in combination with a circulation (strainer and piping) on the impregnation vessel, even if this, of course, reduces the cost advantage.

Moreover, the invention can be used in digesters not having a distinguished counter-current cooking zone. For example in some retrofits of digesters it may be advantageous to position the withdrawal strainers close to the bottom. Also in connection with heavily overloaded digesters that can not be provided with a sufficient supply of wash liquor enabling a sufficient up-flow for counter-current cooking, the invention can be used by supplying wash liquid, as customary, in the bottom and preferably also by means of central pipe displacing liquid radially to a screen section.

Further, it should be understood that some advantages of our invention are also achieved in a two zones digester, even if almost the same temperature is maintained in the concurrent and the counter-current cooking zones.

While the present invention has been described in accordance with preferred compositions and embodiments, it is to be understood that certain substitutions and alterations may be made thereto without departing from the spirit and scope of the following claims.

We claim:

1. A method for continuously producing pulp, comprising the steps of:

providing a finely divided fiber material, a transport liquid and an impregnation zone, the impregnation zone having an inlet portion and an outlet portion;

providing a vessel to facilitate a cooking reaction, the vessel having at least one screen girdle section disposed therein, the vessel having a first concurrent cooking zone;

providing a recovery unit for receiving spent liquor to be recovered;

providing an amount of cooking liquor required for the cooking reaction;

transporting the fiber material and the transport liquid to the impregnation zone;

heating and impregnating the fiber material disposed in the impregnation zone;

passing the heated and impregnated fiber material from the impregnation zone to a top separator of the vessel;

separating the transport liquid from the fiber material in the top separator;

withdrawing a substantial portion of the transport liquid in the top separator;

supplying a first portion of the amount of cooking liquor to the top separator of the vessel;

obtaining a first effective alkali concentration in the first concurrent cooking zone that is at least 35 grams per liter;

passing the fiber material and the cooking liquor through the first concurrent cooking zone;

withdrawing a hot black liquor from at least one of the screen girdle sections, the hot black liqueur having an effective alkali level of at least 13 grams per liter;

transferring a substantial portion of the hot black liquor withdrawn from at least one of screen girdle sections to the inlet portion of the impregnation zone;

separating and withdrawing a substantial portion of a spent impregnation liquor in the top separator; and conducting the spent impregnation liquor to the recovery unit.

2. The method according to claim 1 wherein the step of transferring comprises the step of providing the hot spent cooking liquor withdrawn from at least one of the screen girdle sections with a temperature that is greater than 100 degrees Celsius.

3. The method according to claim 2 wherein the step of providing comprises the step of providing the hot spent cooking liquor with a temperature of between about 120 degrees Celsius and about 160 degrees Celsius.

4. The method according to claim 2 wherein the step of providing comprises the step of providing the hot sp ent cooking liquor with a temperature of between about 140 degrees Celsius and about 160 degrees Celsius.

5. The method according to claim 1 wherein the step of transferring comprises the steps of passing the hot spent cooking liquor to the impregnation zone via a flash tank.

6. The method according to claim 1 wherein the step of transferring comprises the step of transferring at least 70% of the hot spent cooking liquor withdrawn from at least one of the screen girdle sections to the impregnation zone.

7. The method according to claim 1 wherein the step of transferring comprises the step of transferring at least 80% of the hot spent cooking liquor withdrawn from at least one of the screen girdle sections to the impregnation zone.

8. The method according to claim 1 wherein the step of transferring comprises the step of transferring at least 90% of the hot spent cooking liquor withdrawn from at least one of the screen girdle sections to the impregnation zone.

9. The method according to claim 1 wherein the step of transferring comprises the step of transferring about 100% of the hot spent cooking liquor withdrawn from at least one of the screen girdle sections to the impregnation zone.

10. The method according to claim 1 wherein the step of withdrawing hot spent cooking liquor includes the step of withdrawing hot spent cooking liquor having an effective alkaline level that is at least 16 grams per liter.

11. The method according to claim 1 wherein the step of withdrawing hot spent cooking liquor includes the step of withdrawing hot spent cooking liquor having an effective alkaline level that is at least 18 grams per liter.

12. The method according to claim 1 wherein the step of withdrawing hot spent cooking liquor includes the step of withdrawing hot spent cooking liquor having an effective alkaline level that is about 20 grams per liter.

13. The method according to claim 1 wherein the step of obtaining the effective alkaline level includes the step of obtaining an effective alkaline level that exceeds about 40 grams per liter.

14. The method according to claim 1 wherein the step of obtaining the effective alkaline level includes the step of obtaining an effective alkaline level that is between about 45 grams per liter and 55 grams per liter.

15. The method according to claim 1 wherein the method further comprises the steps of providing a liquid stream and the step of providing the impregnation zone comprises providing the impregnation zone with an upstream end and the step of withdrawing hot spent cooking liquor comprises the step of supplying a substantial portion of the hot spent cooking liquor to the upstream end of the impregnation zone so that the hot spent cooking liquor has a flow direction that is concurrent with the liquid stream at the upstream end of the impregnation zone.

16. The method according to claim 1 wherein the step of providing a vessel comprises the steps of providing a vessel having a first concurrent cooking zone with a first temperature and a second counter-current cooking zone having a second temperature, the second temperature being greater than the first temperature.

17. The method according to claim 16 wherein the second temperature is at least 5 degrees Celsius higher than the first temperature.

18. The method according to claim 16 wherein the second temperature is between 5 degrees Celsius and 20 degrees Celsius higher than the first temperature.

19. The method according to claim 16 wherein the second temperature is between 7 degrees Celsius and 15 degrees Celsius higher than the first temperature.

20. The method according to claim 1 wherein the step of providing an impregnation zone comprises the step of providing the impregnation zone in an impregnation vessel that is separate from the vessel and the step of transferring comprises the step of transferring the hot spent cooking liquor to a section that is adjacent to an inlet end of the impregnation vessel.

21. The method according to claim 1 wherein the step of withdrawing a substantial portion comprises the step of withdrawing at least 4 $m^3$/ADT of the spent impregnation liquor.

22. The method according to claim 1 wherein the step of withdrawing a substantial portion comprises the step of withdrawing at least 5 $m^3$/ADT of the spent impregnation liquor.

23. The method according to claim 1 wherein the step of withdrawing a substantial portion of a spent impregnation liquor comprises the step of withdrawing a spent impregnation liquor having an effective alkali value that is below 10 grams per liter.

24. The method according to claim 1 wherein the step of withdrawing a substantial portion of a spent impregnation liquor comprises the step of withdrawing a spent impregnation liquor having an effective alkali value that is below 8 grams per liter.

25. A method for continuously producing pulp, comprising the steps of:

providing a finely divided fiber material, a liquid and an impregnation zone, the impregnation zone maintaining a cooking pressure;

providing a vessel having a top portion and a bottom portion and at least one strainer girdle disposed therein, the vessel being adapted to facilitate a cooking reaction, the vessel having a concurrent cooking zone at the top portion of the vessel, the concurrent cooking zone having a beginning and an end;

providing a hot black liquor;

providing an amount of cooking liquor required for the cooking reaction;

mixing the finely divided fiber material with the liquid to form a slurry;

while mixing the finely divided fiber material, transporting the slurry to the impregnation zone;

while transporting the slurry, prevailing the cooking pressure in the impregnation zone;

while prevailing the cooking pressure, transferring the hot black liquor to the impregnation zone;

while transferring the hot black liquor, heating the fiber material disposed in the impregnation zone to a first temperature that is between about 140 degrees Celsius and 160 degrees Celsius and thoroughly impregnating the fiber material by exposing the fiber material to the hot black liquor;

awhile heating the fiber material, passing the fiber material through the impregnation zone to a top separator at the toy portion of the vessel;

separating and withdrawing a substantial portion of the liquid from the slurry in the top separator;

supplying at least 60% of the cooking liquor to the top separator of the vessel and passing the cooking liquor together with the fiber material to the concurrent cooking zone of the vessel;

obtaining a first level of effective alkaline that is at least 35 grams per liter at the beginning of the concurrent cooking zone;

while obtaining the first level of effective alkaline, withdrawing spent liquor, that have passed through the concurrent cooking zone of the vessel, at the strainer girdle of the vessel, the spent liquor having an effective alkali level of at least 13 grams per liter;

removing pulp from the bottom portion of the vessel; and maintaining a second temperature in the beginning of the concurrent cooking zone that is higher than the first temperature of the impregnation zone, the second temperature being above 160 degrees Celsius.

* * * * *